US007854602B2

(12) United States Patent
Bae et al.

(10) Patent No.: US 7,854,602 B2
(45) Date of Patent: Dec. 21, 2010

(54) ROTARY COMPRESSOR FOR CHANGING COMPRESSION CAPACITY

(75) Inventors: Ji Young Bae, Busan (KR); Chul Gi Roh, Changwon-Si (KR); Kyoung Jun Park, Changwon-Si (KR); Chang Yong Jang, Gwangju (KR); Jong Bong Kim, Changwon-Si (KR); Young Hwan Ko, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 911 days.

(21) Appl. No.: 10/556,428

(22) PCT Filed: Apr. 27, 2004

(86) PCT No.: PCT/KR2004/000964

§ 371 (c)(1),
(2), (4) Date: Apr. 23, 2007

(87) PCT Pub. No.: WO2004/102000

PCT Pub. Date: Nov. 25, 2004

(65) Prior Publication Data

US 2007/0280843 A1 Dec. 6, 2007

(30) Foreign Application Priority Data

May 13, 2003 (KR) ..... 10-2003-0030347

(51) Int. Cl.
*F04C 2/00* (2006.01)
*F04C 28/18* (2006.01)

(52) U.S. Cl. ..... 418/32; 418/11; 418/23; 418/60; 418/270; 417/218; 417/326; 137/625.21

(58) Field of Classification Search ..... 418/32, 418/11, 23, 60, 63, 270; 417/218, 221, 223, 417/212, 315, 326; 13/625.21; 251/175, 251/180

See application file for complete search history.

(56) References Cited

U.S. PATENT DOCUMENTS 3,742,979 A * 7/1973 Woodling ..... 137/625.24
3,985,473 A * 10/1976 King et al. ..... 418/32

(Continued)

FOREIGN PATENT DOCUMENTS

JP 58156194 U * 10/1983

(Continued)

*Primary Examiner*—Theresa Trieu
(74) *Attorney, Agent, or Firm*—Birch, Stewart, Kolasch & Birch, LLP

(57) ABSTRACT

A rotary compressor for changing a compression capacity of the compressor includes a driving shaft being rotatable clockwise and counterclockwise, and having an eccentric portion of a predetermined size; a cylinder forming a predetermined inner volume; a roller installed rotatably on an outer circumference of the eccentric portion so as to contact an inner circumference of the cylinder; a vane installed elastically in the cylinder to contact the roller continuously; a first bearing installed in the cylinder, for rotatably supporting the driving shaft; a second bearing installed in the cylinder, for rotatably supporting the driving shaft and guiding the fluid into the fluid chamber; discharge ports communicating with the fluid chamber; and a valve assembly having openings separated by a predetermined angle from each other, the valve assembly having a center which is eccentrically installed by a predetermined distance from a center of the cylinder.

63 Claims, 25 Drawing Sheets

U.S. PATENT DOCUMENTS

| | | | |
|---|---|---|---|
| 4,598,559 | A | 7/1986 | Tomayko et al. |
| 6,213,732 | B1 | 4/2001 | Fujio |

FOREIGN PATENT DOCUMENTS

| | | | | |
|---|---|---|---|---|
| JP | 60142087 | A | * | 7/1985 |
| JP | 62126290 | A | * | 6/1987 |
| JP | 63032192 | A | * | 2/1988 |
| JP | 63-50693 | A | | 3/1988 |

* cited by examiner

ROTARY COMPRESSOR FOR CHANGING COMPRESSION CAPACITY

TECHNICAL FIELD

The present invention relates to a rotary compressor, and more particularly, to a mechanism for changing compression capacity of a rotary compressor.

BACKGROUND ART

In general, compressors are machines that are supplied power from a power generator such as electric motor, turbine or the like and apply compressive work to a working fluid, such as air or refrigerant to elevate the pressure of the working fluid. Such compressors are widely used in a variety of applications, from electric home appliances such as air conditioners, refrigerators and the like to industrial plants.

The compressors are classified into two types according to their compressing methods: a positive displacement compressor, and a dynamic compressor (a turbo compressor). The positive displacement compressor is widely used in industry fields and configured to increase pressure by reducing its volume. The positive displacement compressors can be further classified into a reciprocating compressor and a rotary compressor.

The reciprocating compressor is configured to compress the working fluid using a piston that linearly reciprocates in a cylinder. The reciprocating compressor has an advantage of providing high compression efficiency with a simple structure. However, the reciprocation compressor has a limitation in increasing its rotational speed due to the inertia of the piston and a disadvantage in that a considerable vibration occurs due to the inertial force. The rotary compressor is configured to compress working fluid using a roller eccentrically revolving along an inner circumference of the cylinder, and has an advantage of obtaining high compression efficiency at a low speed compared with the reciprocating compressor, thereby reducing noise and vibration.

Recently, compressors having at least two compression capacities have been developed. These compressors have compression capacities different from each other according to the rotation directions (i.e., clockwise direction and counterclockwise direction) by using a partially modified compression mechanism. Since compression capacity can be adjusted differently according to loads required by these compressors, such a compressor is widely used to increase an operation efficiency of several equipments requiring the compression of working fluid, especially household electric appliances such as a refrigerator that uses a refrigeration cycle.

However, a conventional rotary compressor has separately a suction portion and a discharge portion which communicate with a cylinder. The roller rolls from the suction port to the discharge portion along an inner circumference of the cylinder, so that the working fluid is compressed. Accordingly, when the roller rolls in an opposite direction (i.e., from the discharge portion to the suction portion), the working fluid is not compressed. In other words, the conventional rotary compressor cannot have different compression capacities if the rotation direction is changed. Accordingly, there is a demand for a rotary compressor having variable compression capacities as well as the aforementioned advantages.

DISCLOSURE OF INVENTION

Accordingly, the present invention is directed to a rotary compressor that substantially obviates one or more problems due to limitations and disadvantages of the related art.

An object of the present invention is to provide a rotary compressor whose compression capacity can be varied.

Another object of the present invention is to provide a rotary compressor in which a dead area that may be incurred in the compression space, i.e., where the compression is not performed or is impossible, is completely eliminated to obtain a desired compression efficiency with accuracy.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a rotary compressor comprising: a driving shaft being rotatable clockwise and counterclockwise, and having an eccentric portion of a predetermined size; a cylinder forming a predetermined inner volume; a roller installed rotatably on an outer circumference of the eccentric portion so as to contact an inner circumference of the cylinder, performing a rolling motion along the inner circumference and forming a fluid chamber to suck and compress fluid along with the inner circumference; a vane installed elastically in the cylinder to contact the roller continuously; a first bearing installed in the cylinder, for rotatably supporting the driving shaft; a second bearing installed in the cylinder, for rotatably supporting the driving shaft and guiding the fluid into the fluid chamber; discharge ports communicating with the fluid chamber; and a valve assembly having openings separated by a predetermined angle from each other, for allowing the openings to selectively introduce the fluid into the fluid chamber through the second bearing at a predetermined position of the fluid chamber according to rotation direction of the driving shaft, the valve assembly having a center which is eccentrically installed by a predetermined distance from a center of the cylinder.

According to the present invention described above, two different compression capacities can be obtained according to the rotation direction of the driving shaft.

It is to be understood that both the foregoing general description and the following detailed description of the present invention are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this application, illustrate embodiment(s) of the invention and together with the description serve to explain the principle of the invention. In the drawings.

BEST MODE FOR CARRYING OUT THE INVENTION

Reference will now be made in detail to the preferred embodiments of the present invention to achieve the objects, with examples of which are illustrated in the accompanying drawings. Wherever possible, the same reference numbers will be used throughout the drawings to refer to the same or like parts.

Figure 1:
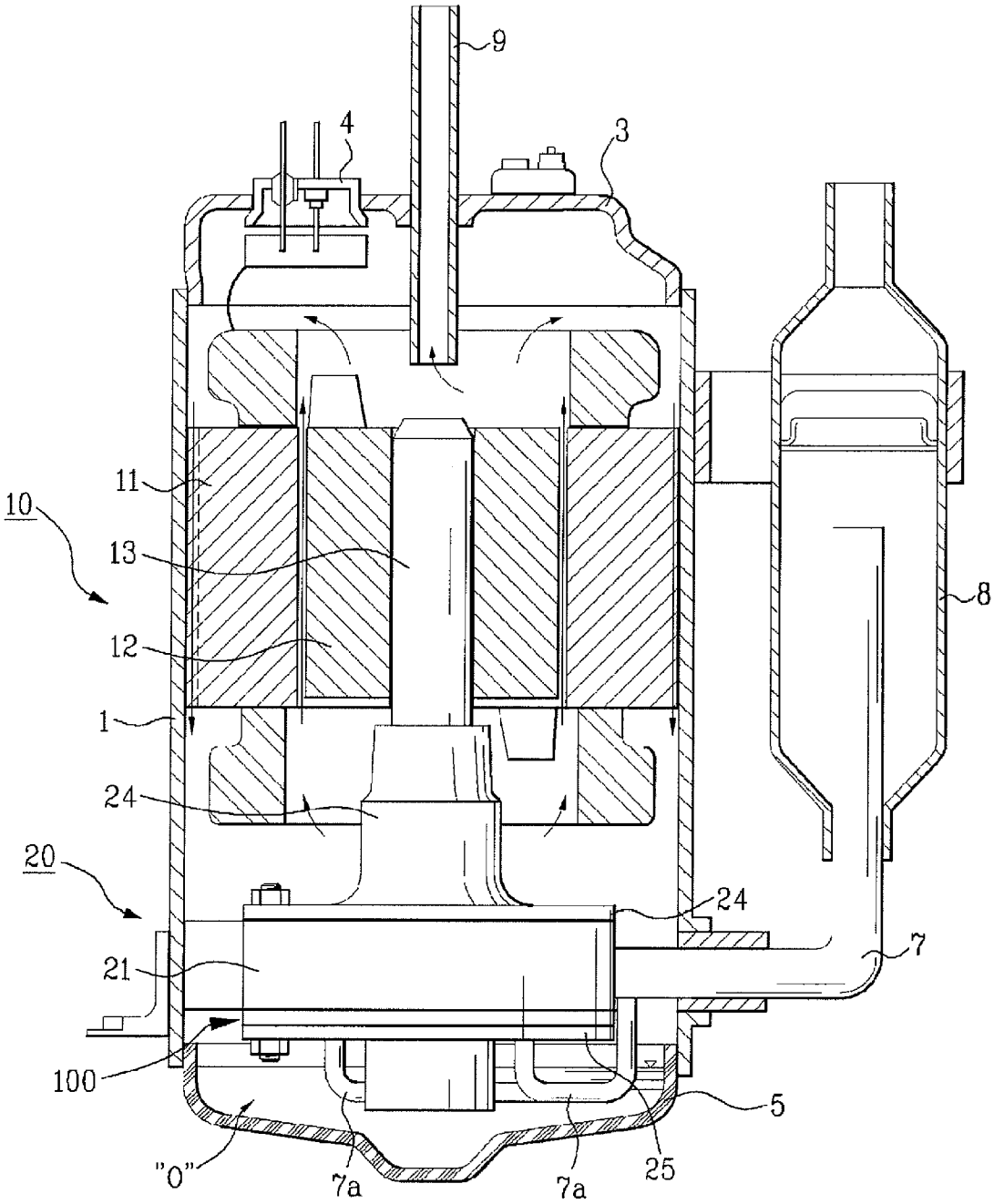
FIG. 1 is a partial longitudinal sectional view illustrating a rotary compressor according to an embodiment of the present invention.
Figure 2:
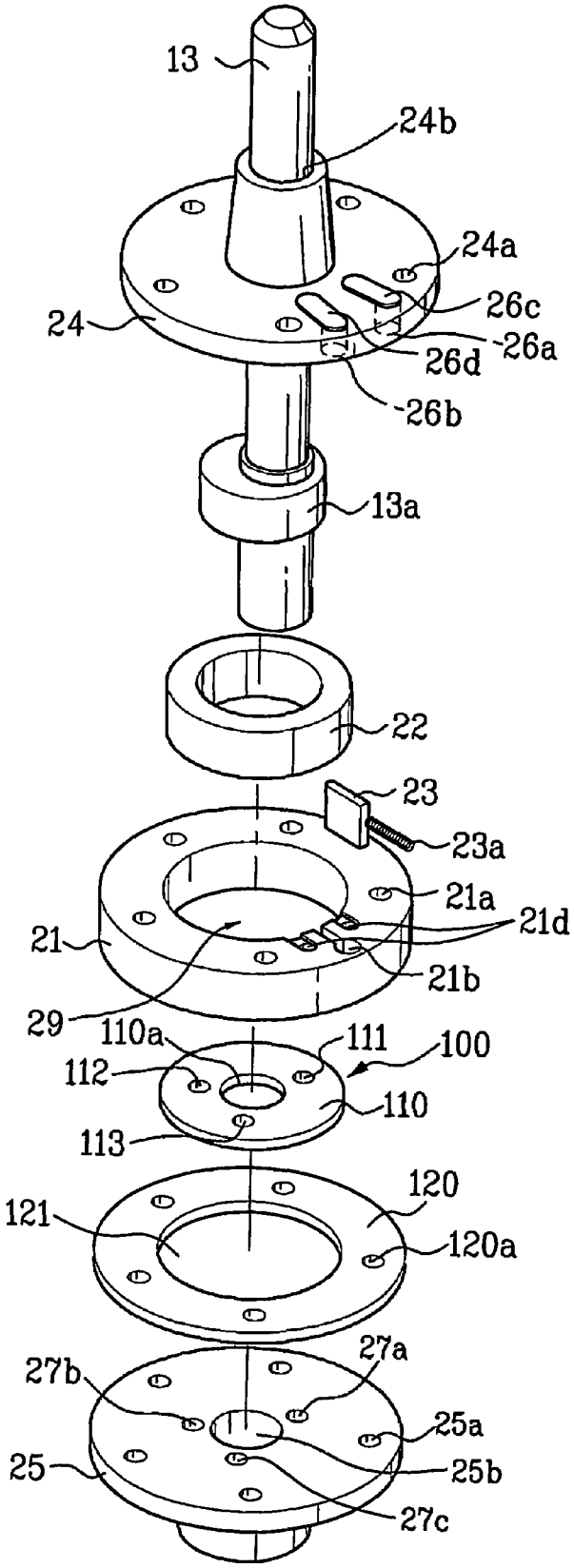
FIG. 2 is an exploded perspective view illustrating that a valve assembly that is not biased eccentrically is installed in the compressing unit of the rotary compressor of FIG. 1.
Figure 3:
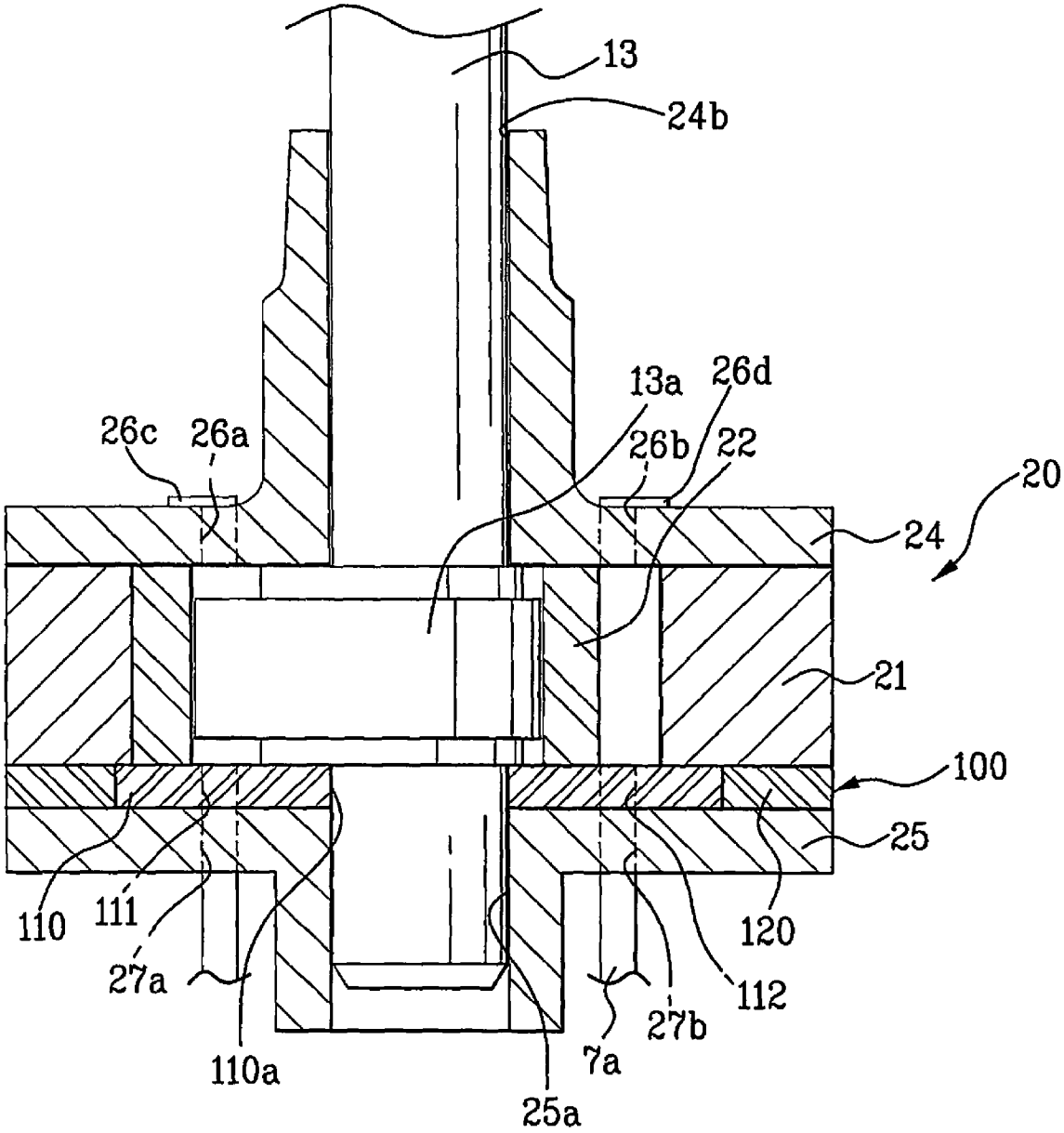
FIG. 3 is a sectional view illustrating the compressing unit of FIG. 2.

FIG. 1 is a partial longitudinal sectional view illustrating a rotary compressor according to an embodiment of the present invention, FIG. 2 is an exploded perspective view illustrating that a valve assembly that is not biased eccentrically is installed in the compressing unit of the rotary compressor of FIG. 1, and FIG. 3 is a sectional view illustrating the compressing unit of FIG. 2. An embodiment of the present invention will be described with reference to FIGS. 1 to 3.

As shown in FIG. 1, a rotary compressor of the present invention includes a case 1, a power generator 10 positioned in the case 1 and a compressing unit 20. Referring to FIG. 1, the power generator 10 is positioned on the upper portion of the rotary compressor and the compressing unit 20 is positioned on the lower portion of the rotary compressor. However, their positions may be changed if necessary. An upper cap 3 and a lower cap 5 are installed on the upper portion and the lower portion of the case 1 respectively to define a sealed inner space. A suction pipe 7 for sucking working fluid is installed on a side of the case 1 and connected to an accumulator 8 for separating lubricant from refrigerant. A discharge tube 9 for discharging the compressed fluid is installed on the center of the upper cap 3. A predetermined amount of the lubricant "0" is filled in the lower cap 5 so as to lubricate and cool members that are moving frictionally. Here, an end of a driving shaft 13 is dipped in the lubricant.

The power generator 10 includes a stator 11 fixed in the case 1, a rotor 12 rotatable supported in the stator 11 and the driving shaft 13 inserted forcibly into the rotor 12. The rotor 12 is rotated due to electromagnetic force, and the driving shaft 13 delivers the rotation force of the rotor to the compressing unit 20. To supply external power to the stator 20, a terminal 4 is installed in the upper cap 3.

The compressing unit 20 includes a cylinder 21 fixed to the case 1, a roller 22 positioned in the cylinder 21 and first and second bearings 24 and 25 respectively installed on first and second portions of the cylinder 21. The compressing unit 20 also includes a valve assembly 100 installed between the second bearing 25 and the cylinder 21. The compressing unit 20 will be described in more detail with reference to FIGS. 2, 3 and 4.

The cylinder 21 has a predetermined inner volume and a strength enough to endure the pressure of the fluid. The cylinder 21 accommodates an eccentric portion 13*a* formed on the driving shaft 13 in the inner volume. The eccentric portion 13*a* is a kind of an eccentric cam and has a center spaced by a predetermined distance from its rotation center. The cylinder 21 has a groove 21*b* extending by a predetermined depth from its inner circumference. A vane 23 to be described below is installed on the groove 21*b*. The groove 21*b* is long enough to accommodate the vane 23 completely.

Figure 4:
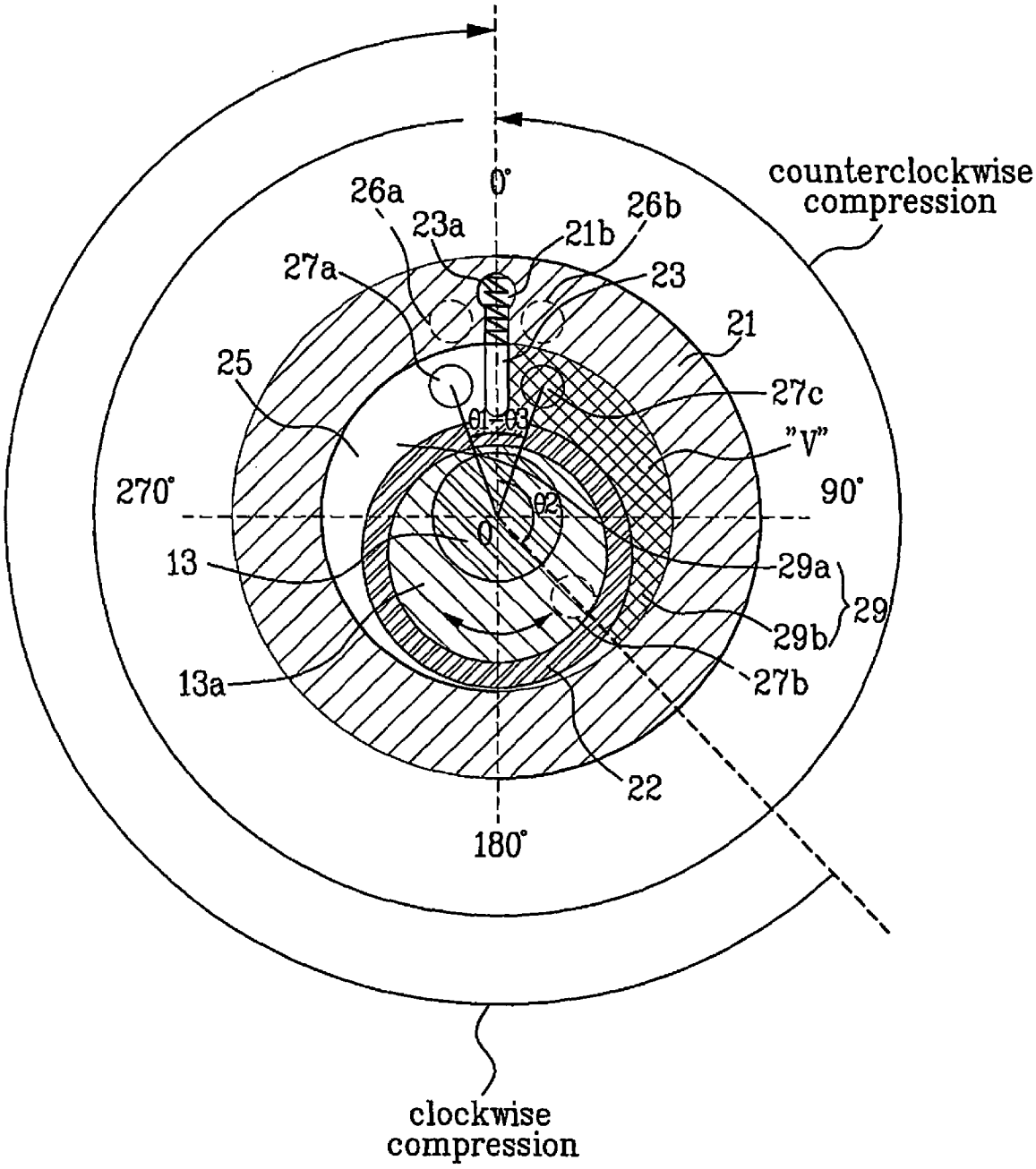
FIG. 4 is a cross-sectional view illustrating the inside of the cylinder of FIGS. 2 and 3.

The roller 22 is a ring member that has an outer diameter less than the inner diameter of the cylinder 21. As shown in FIG. 4, the roller 22 contacts the inner circumference of the cylinder 21 and rotatably coupled with the eccentric portion 13*a*. Accordingly, the roller 22 performs rolling motion on the inner circumference of the cylinder 21 while spinning on the outer circumference of the eccentric portion 13*a* when the driving shaft 13 rotates. The roller 22 revolves spaced apart by a predetermined distance from the rotation center '0' due to the eccentric portion 13*a* while performing the rolling motion. Since the outer circumference of the roller 22 always contacts the inner circumference due to the eccentric portion 13*a*, the outer circumference of the roller 22 and the inner circumference of the cylinder form a separate fluid chamber 29 in the inner volume. The fluid chamber 29 is used to suck and compress the fluid in the rotary compressor.

The vane 23 is installed in the groove 21*b* of the cylinder 21 as described above. An elastic member 23*a* is installed in the groove 21*b* to elastically support the vane 23. The vane 23 continuously contacts the roller 22. In other words, the elastic member 23*a* has one end fixed to the cylinder 21 and the other end coupled with the vane 23, and pushes the vane 23 to the side of the roller 22. Accordingly, the vane 23 divides the fluid chamber 29 into two separate spaces 29*a* and 29*b* as shown in FIG. 4. While the driving shaft 13 rotate or the roller 22 revolves, the volumes of the spaces 29*a* and 29*b* change complementarily. In other words, if the roller 22 rotates clockwise, the space 29*a* gets smaller but the other space 29*b* gets larger. However, the total volume of the spaces 29*a* and 29*b* is constant and approximately same as that of the predetermined fluid chamber 29. One of the spaces 29*a* and 29*b* works as a suction chamber for sucking the fluid and the other one works as a compression chamber for compressing the fluid relatively when the driving shaft 13 rotates in one direction (clockwise or counterclockwise). Accordingly, as described above, the compression chamber of the spaces 29*a* and 29*b* gets smaller to compress the previously sucked fluid and the suction chamber expands to suck the new fluid relatively according to the rotation of the roller 22. If the rotation direction of the roller 22 is reversed, the functions of the spaces 29*a* and 29*b* are exchanged. In the other words, if the roller 22 revolves counterclockwise, the right space 29*b* of the roller 22 becomes a compression chamber, but if the roller 22 revolves clockwise, the left space 29*a* of the roller 22 becomes a discharge unit.

The first bearing 24 and the second bearing 25 are, as shown in FIG. 2, installed on the upper and lower portions of the cylinder 21 respectively, and rotatably support the driving shaft 12 using a sleeve and the penetrating holes 24*b* and 25*b* formed inside the sleeve. More particularly, the first bearing 24, the second bearing 25 and the cylinder 21 include a plurality of coupling holes 24*a*, 25*a* and 21*a* formed to correspond to each other respectively. The cylinder 21, the first bearing 24 and the second bearing 25 are coupled with one another to seal the cylinder inner volume, especially the fluid chamber 29 using coupling members such as bolts and nuts. The discharge ports 26*a* and 26*b* are formed on the first bearing 24. The discharge ports 26*a* and 26*b* communicate with the fluid chamber 29 so that the compressed fluid can be discharged. The discharge ports 26*a* and 26*b* can communicate directly with the fluid chamber 29 or can communicate with the fluid chamber 29 through a predetermined fluid passage 21*d* formed in the cylinder 21 and the first bearing 24. Discharge valves 26*c* and 26*d* are installed on the first bearing 24 so as to open and close the discharge ports 26*a* and 26*b*. The discharge valves 26*c* and 26*d* selectively open the discharge ports 26*a* and 26*b* only when the pressure of the chamber 29 is greater than or equal to a predetermined pressure. To achieve this, it is desirable that the discharge valves 26*c* and 26*d* are leaf springs of which one end is fixed in the vicinity of the discharge ports 26 and 26*b* and the other end can be deformed freely. Although not shown in the drawings, a retainer for limiting the deformable amount of the leaf spring may be installed on the upper portion of the discharge valves 26*c* and 26*d* so that the valves can operate stably. In addition, a muffler (not shown) can be installed on the upper portion of the first bearing 24 to reduce a noise generated when the compressed fluid is discharged.

The suction ports 27*a*, 27*b* and 27*c* communicating with the fluid chamber 29 are formed on the second bearing 25. The suction ports 27*a*, 27*b* and 27*c* guide the compressed fluid to the fluid chamber 29. The suction ports 27*a*, 27*b* and 27*c* are connected to the suction pipe 7 so that the fluid outside of the compressor can flow into the chamber 29. More particularly, the suction pipe 7 is branched into a plurality of auxiliary tubes 7*a* and is connected to suction ports 27 respectively. If necessary, the discharge ports 26*a*, and 26*b* may be formed on the second bearing 25 and the suction ports 27*a*, 27*b* and 27*c* may be formed on the first bearing 24.

The suction and discharge ports 26 and 27 become the important factors in determining compression capacity of the rotary compressor and will be described referring to FIGS. 4 and 5. FIG. 4 illustrates a cylinder coupled with the second bearing 25 without a valve assembly 100 to show the suction ports 27.

First, the compressor of the present invention includes at least two discharge ports 26*a* and 26*b*. As shown in the drawing, even if the roller 22 revolves in any direction, a discharge port should exist between the suction port and vane 23 positioned in the revolution path to discharge the compressed fluid. Accordingly, one discharge port is necessary for each rotation direction. It causes the compressor of the present invention to discharge the fluid independent of the revolution direction of the roller 22 (that is, the rotation direction of the driving shaft 13). Meanwhile, as described above, the compression chamber of the spaces 29*a* and 29*b* gets smaller to compress the fluid as the roller 22 approaches the vane 23. Accordingly, the discharge ports 26*a* and 26*b* are preferably formed facing each other in the vicinity of the vane 23 to discharge the maximum compressed fluid. In other word, as shown in the drawings, the discharge ports 26*a* and 26*b* are positioned on both sides of the vane 23 respectively. The discharge ports 26*a* and 26*b* are preferably positioned in the vicinity of the vane 23 if possible.

The suction port 27 is positioned properly so that the fluid can be compressed between the discharge ports 26*a* and 26*b* and the roller 22. Actually, the fluid is compressed from a suction port to a discharge port positioned in the revolution path of the roller 22. In other words, the relative position of the suction port for the corresponding discharge port determines the compression capacity and accordingly two compression capacities can be obtained using different suction ports 27 according to the rotation direction. Accordingly, the compression of the present invention has first and second suction ports 27*a* and 27*b* corresponding to two discharge ports 26*a* and 26*b* respectively and the suction ports are separated by a predetermined angle from each other with respect to the center 0 for two different compression capacities.

Figure 5A:
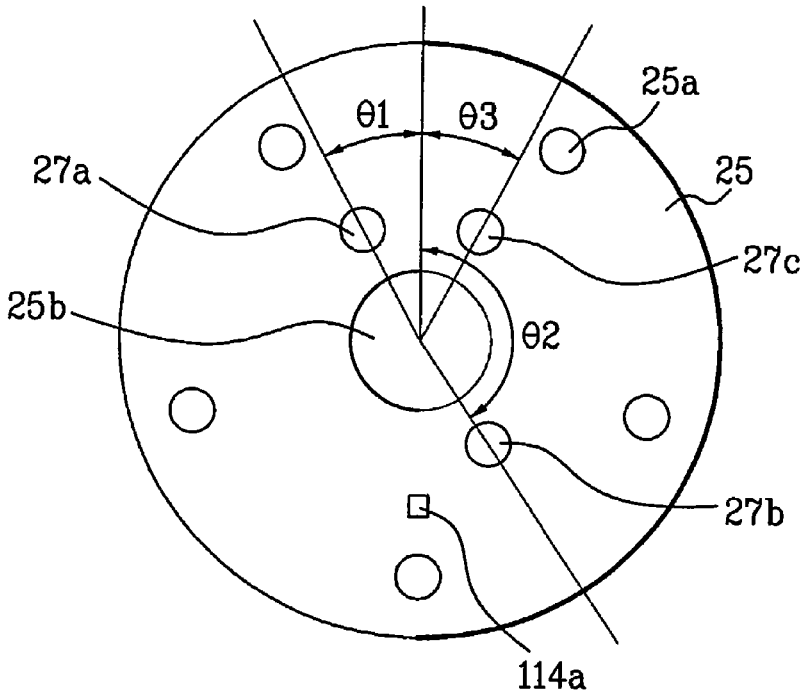
FIGS. 5A and 5B are plan views illustrating a second bearing of the rotary compressor of FIGS. 2 and 3.

Preferably, the first suction port 27*a* is positioned in the vicinity of the vane 23. Accordingly, the roller 22 compresses the fluid from the first suction port 27*a* to the second discharge port 26*b* positioned across the vane 23 in its rotation in one direction (counterclockwise in the drawing). The roller 22 compress the fluid due to the first suction port 27*a* by using the overall chamber 29 and accordingly the compressor has a maximum compression capacity in the counterclockwise rotation. In other words, the fluid as much as overall volume of the chamber 29 is compressed. The first suction port 27*a* is actually separated by an angle θ1 of 10° clockwise or counterclockwise from the vane 23 as shown in FIGS. 4 and 5A. The drawings of the present invention illustrates the first suction port 27*a* separated by the angle θ1 counterclockwise. At this separating angle θ1, the overall fluid chamber 29 can be used to compress the fluid without interference of the vane 23.

The second suction port 27*b* is separated by a predetermined angle from the first suction port 27*a* with respect to the center. The roller 20 compresses the fluid from the second suction port 27*b* to the first discharge port 26*a* in its rotation in counterclockwise direction. Since the second suction port 27*b* is separated by a considerable angle clockwise from the vane 23, the roller 22 compresses the fluid by using a portion of the chamber 29 and accordingly the compressor has the less compression capacity than that of counterclockwise rotary motion. In other words, the fluid as much as a portion volume of the chamber 29 is compressed. The second suction port 27*b* is preferably separated by an angle θ2 of a range of 90-180° clockwise or counterclockwise from the vane 23. The second suction port 27*b* is preferably positioned facing the first suction port 27*a* so that the difference between compression capacities can be made properly and the interference can be avoid for each rotation direction.

Figure 5B:
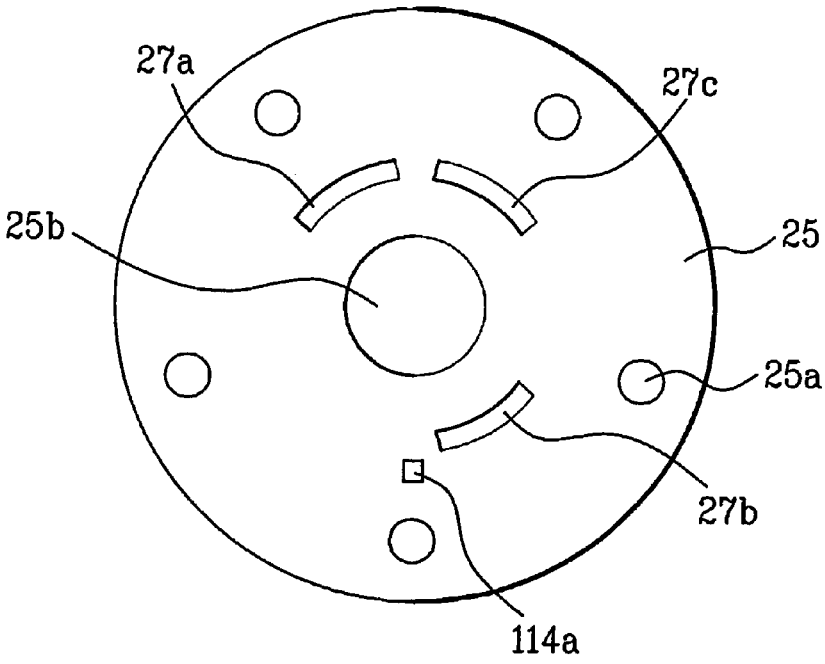

As shown in FIG. 5A, the suction ports 27*a* and 27*b* are generally in circular shapes whose diameters are, preferably, 6-15 mm. In order to increase a suction amount of fluid, the suction ports 27*a* and 27*b* can also be provided in several shapes, including a rectangle. Further, as shown in FIG. 5B, the suction ports 27*a* and 27*b* can be in rectangular shapes having predetermined curvature. In this case, an interference with adjacent other parts, especially the roller 22, can be minimized in operation.

Meanwhile, in order to obtain desired compression capacity in each rotation direction, suction ports that are available in any one of rotation directions should be single. If there are two suction ports in rotation path of the roller 22, the compression does not occur between the suction ports. In other words, if the first suction port 27*a* is opened, the second suction port 27*b* should be closed, and vice versa Accordingly, for the purpose of electively opening only one of the suction ports 27*a* and 27*b* according to the revolution direction of the roller 22, the valve assembly 100 is installed in the compressor of the present invention.

In the compressor of the present invention, the valve assembly is installed such that center thereof is spaced apart by a predetermined distance from the centers of the driving shaft 13 and the cylinder 21. However, in FIGS. 2 to 4, there is shown the valve assembly 100, which is installed in a non-biased state. This is to help readers' understanding by describing the valve assembly structure and the compressor of the invention more easily and also to describe why the valve assembly has an axially biased structure. The valve assembly 100 installed in non-biased state shown in FIGS. 2 to 4, is substantially the same in its basic structure as the valve assembly 400 installed in a biased state shown in FIG. 12 and the like. Hence, the structure of the biased valve assembly will be described along with the description of the valve assembly 100 which is installed in non-biased state. Structural modifications that are necessary for axially biasing the valve assembly 400 will be described later separately.

Figure 6:
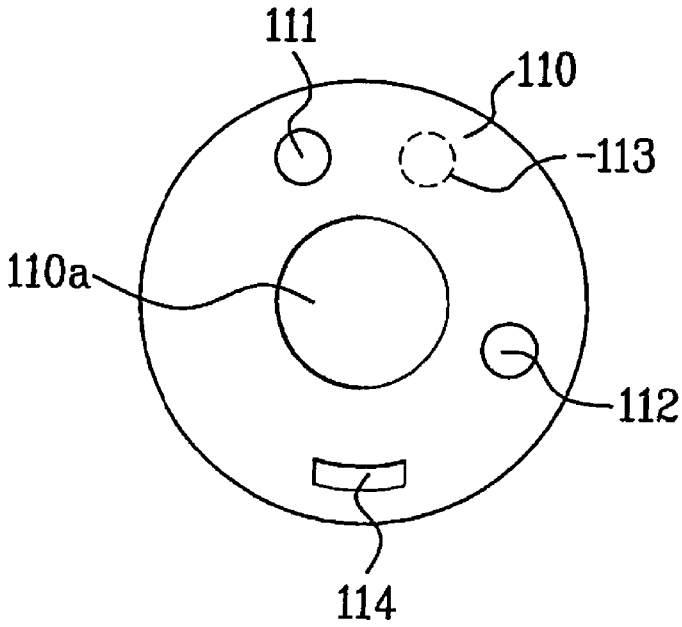
FIG. 6 is a plan view illustrating a valve assembly of the compressing unit of FIGS. 2 and 3.
Figure 6:
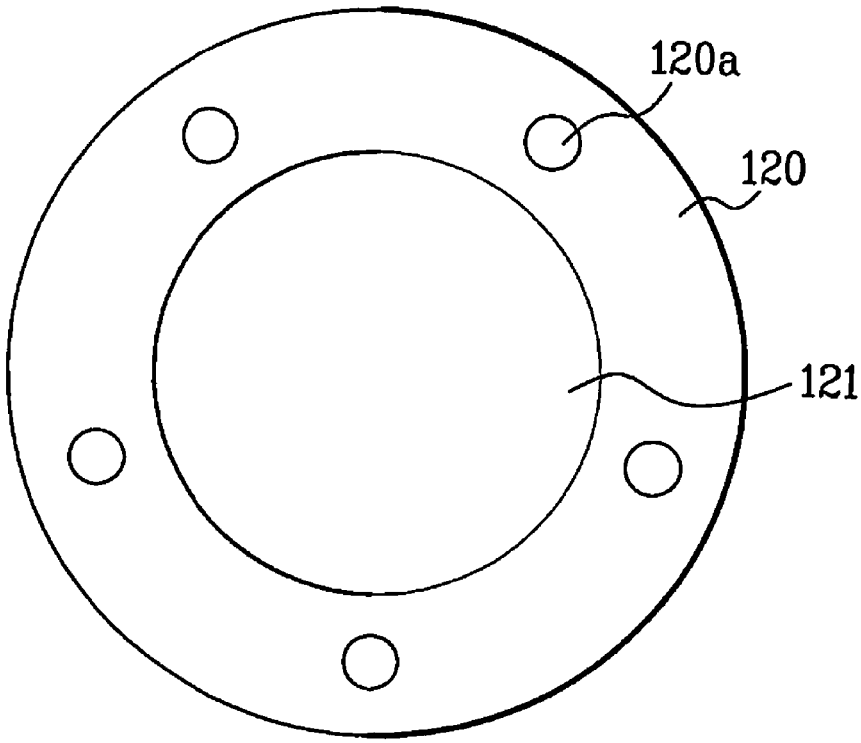

As shown in FIGS. 2, 3 and 6, the valve assembly 100 includes first and second valves 110 and 120, which are installed between the cylinder 21 and the second bearing 25 so as to allow it to be adjacent to the suction ports. If the suction ports 27*a*, 27*b* and 27*c* are formed on the first bearing 24, the first and second valves 110 and 120 are installed between the cylinder 21 and the first bearing 24.

The first valve 110, as shown in FIG. 3, is a disk member installed so as to contact the eccentric portion 13*a* more accurately than the driving shaft 13. Accordingly, if the driving shaft 13 rotates (that is, the roller 22 revolves), the first valve 110 rotates in the same direction. Preferably, the first valve 110 has a diameter larger than an inner diameter of the cylinder 21. As shown in FIG. 3, the cylinder 21 supports a portion (i.e., an outer circumference) of the first valve 110 so that the first valve 110 can rotate stably. Preferably, the first valve 110 is 0.5-5 mm thick.

Figure 7A:
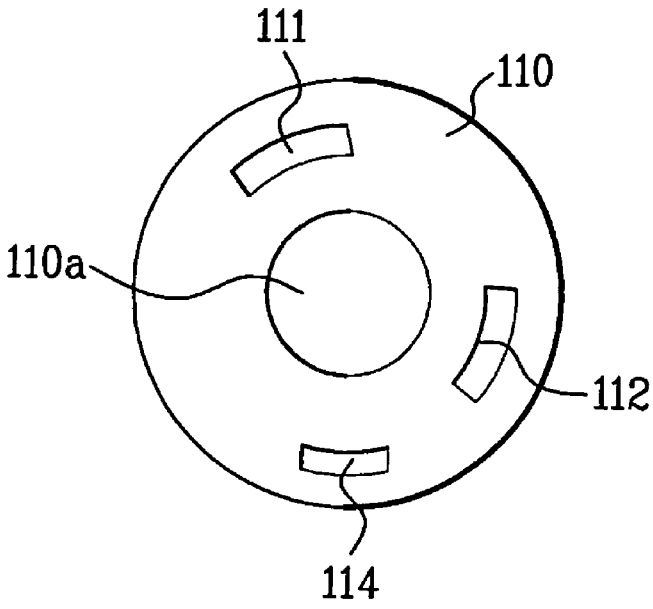
FIGS. 7A and 7C are plan views illustrating modifications of a valve assembly.
Figure 7B:
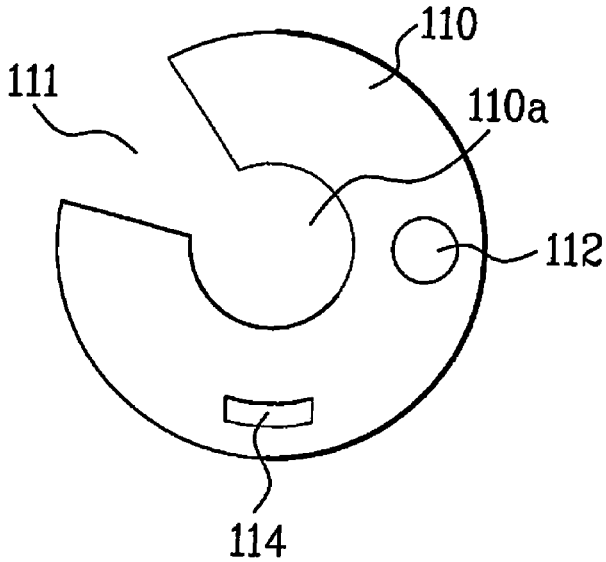
Figure 7C:
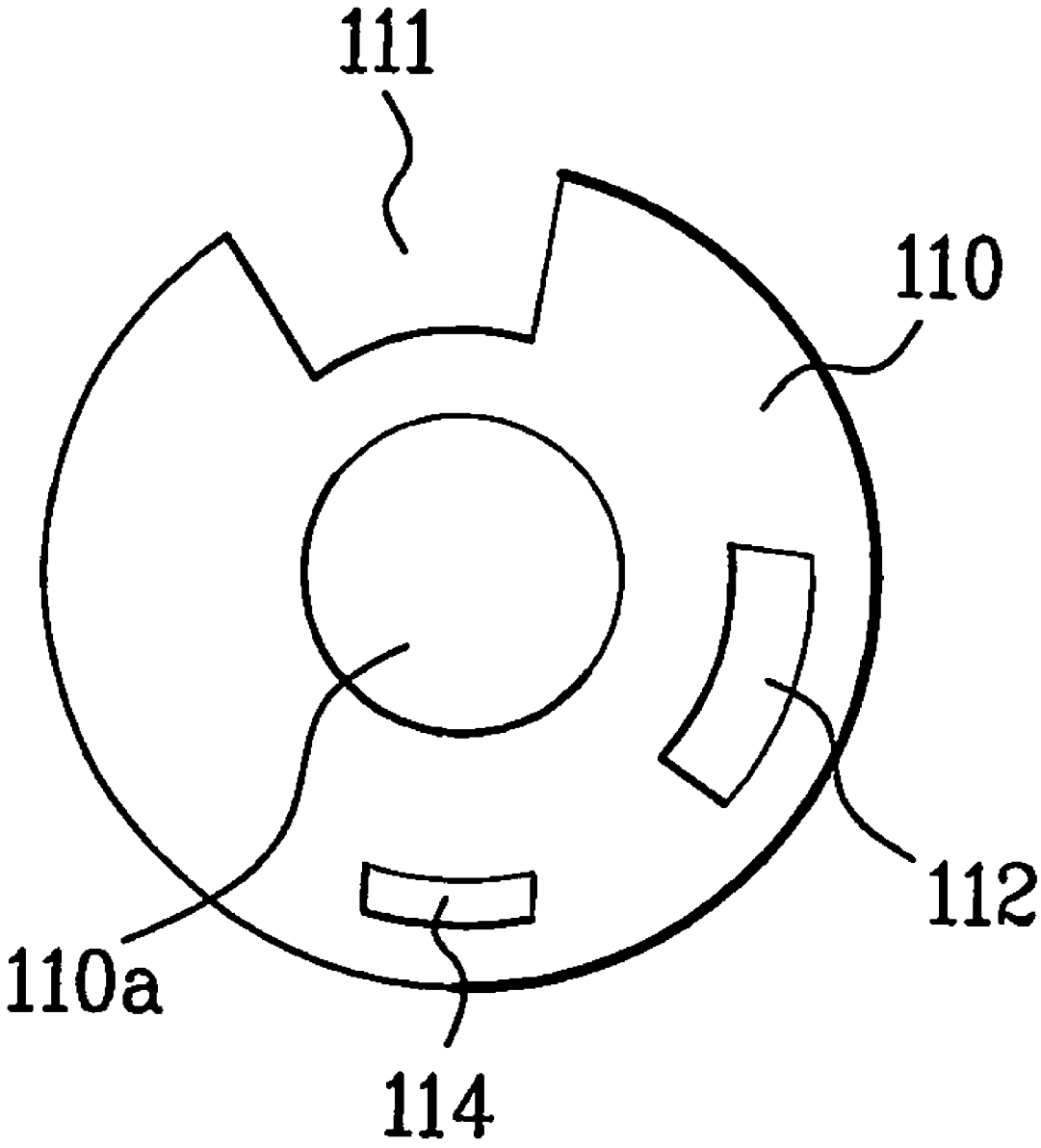

Referring to FIGS. 2 and 6, the first valve 110 includes first and second openings 111 and 112 respectively communicating with the first and second suction ports 27*a* and 27*b* in specific rotation direction, and a penetration hole 110*a* into which the driving shaft 13 is inserted. In more detail, when the roller 22 rotates in any one of the clockwise and counterclockwise directions, the first opening 111 communicates with the first suction port 27*a* by the rotation of the first valve 110, and the second suction port 27*b* is closed by the body of the first valve 110. When the roller 22 rotates in the other of the clockwise and counterclockwise directions, the second opening 112 communicates with the second suction port 27*b*. At this time, the first suction port 27*a* is closed by the body of the first valve 110. These first and second openings 111 and 112 can be in circular or polygonal shapes. In case the openings 111 and 112 are the circular shapes, it is desired that the openings 111 and 112 are 6-15 mm in diameter. Additionally, the openings 111 and 112 can be rectangular shapes having predetermined curvature as shown in FIG. 7A, or cut-away portions as shown in FIG. 7B. As a result, the openings are enlarged, such that fluid is sucked smoothly. If these openings 111 and 112 are formed adjacent to a center of the first valve 110, a probability of interference between the roller 22 and the eccentric portion 13*a* becomes increasing. In addition, there is the fluid's probability of leaking out along the driving shaft 13, since the openings 111 and 112 communicate with a space between the roller 22 and the eccentric portion 13*a*. For these reasons, as shown in FIG. 7C, it is preferable that the openings 111 and 112 are positioned in the vicinity of the outer circumference of the first valve. Meanwhile, the first opening 111 may open each of the first and second suction ports 27*a* and 27*b* at each rotation direction by adjusting the rotation angle of the first valve 110. In other words, when the driving shaft 13 rotates in any one of the clockwise and counterclockwise directions, the first opening 111 communicates with the first suction port 27*a* while closing the second suction port 27*b*. When the driving shaft 13 rotates in the other of the clockwise and counterclockwise directions, the first opening 111 communicates with the second suction port 27*b* while closing the first suction port 27*a*. It is desirable to control the suction ports using such a single opening 111, since the structure of the first valve 110 is simplified much more.

Referring to FIGS. 2, 3 and 6, the second valve 120 is fixed between the cylinder 21 and the second bearing 25 so as to guide a rotary motion of the first valve 110. The second valve 120 is a ring-shaped member having a site portion 121 which receives rotatably the first valve 110. The second valve 120 further includes a coupling hole 120*a* through which it is coupled with the cylinder 21 and the first and second bearings 24 and 25 by a coupling member. Preferably, the second valve 120 has the same thickness as the first valve 110 in order for a prevention of fluid leakage and a stable support. In addition, since the first valve 110 is partially supported by the cylinder 21, the first valve 110 may have a thickness slightly smaller than the second valve 120 in order to form a clearance for the smooth rotation of the second valve 120.

Meanwhile, referring to FIG. 4, in the case of the clockwise rotation, the fluid's suction or discharge between the vane 23 and the roller 22 does not occur while the roller 22 revolves from the vane 23 to the second suction port 27*b*. Accordingly, a region V becomes a vacuum state. The vacuum region V causes a power loss of the driving shaft 13 and a loud noise. Accordingly, in order to overcome the problem in the vacuum region V, a third suction port 27*c* is provided at the second bearing 25. The third suction port 27*c* is formed between the second suction port 27*b* and the vane 23, supplying fluid to the space between the roller 22 and the vane 23 so as not to form the vacuum state before the roller 22 passes through the second suction port 27*b*. Preferably, the third suction port 27*c* is formed in the vicinity of the vane 23 so as to remove quickly the vacuum state. However, the third suction port 27*c* is positioned to face the first suction port 27*a* since the third suction port 27*c* operates at a different rotation direction from the first suction port 27*a*. In reality, the third suction port 27*c* is positioned spaced by an angle (θ3) of approximately 10° from the vane 23 clockwise or counterclockwise. In addition, as shown in FIGS. 5A and 5B, the third suction port 27*c* can be circular shapes or curved rectangular shapes.

Since the third suction port 27*c* operates along with the second suction port 27*b*, the suction ports 27*b* and 27*c* should be simultaneously opened while the roller 22 revolves in any one of the clockwise and counterclockwise directions. Accordingly, the first valve 10 further includes a third opening configured to communicate with the third suction port 27*c* at the same time when the second suction port 27*b* is opened. According to the present invention, the third opening 113 can be formed independently, which is represented with a dotted line in FIG. 6A. However, since the first and third suction ports 27*a* and 27*c* are adjacent to each other, it is desirable to open both the first and third suction ports 27*a* and 27*c* according to the rotation direction of the first opening 111 by increasing the rotation angle of the first valve 110.

The first valve 110 may open the suction ports 27*a*, 27*b* and 27*c* according to the rotation direction of the roller 22, but the corresponding suction ports should be opened accurately in order to obtain desired compression capacity. The accurate opening of the suction ports can be achieved by controlling the rotation angle of the first valve. Thus, preferably, the valve assembly 100 further includes means for controlling the rotation angle of the first valve 110, which will be described in detail with reference to FIGS. 8 to 11. FIGS. 8 to 11 illustrate the valve assembly connected with the second bearing 25 in order to clearly explain the control means.

Figure 8A:
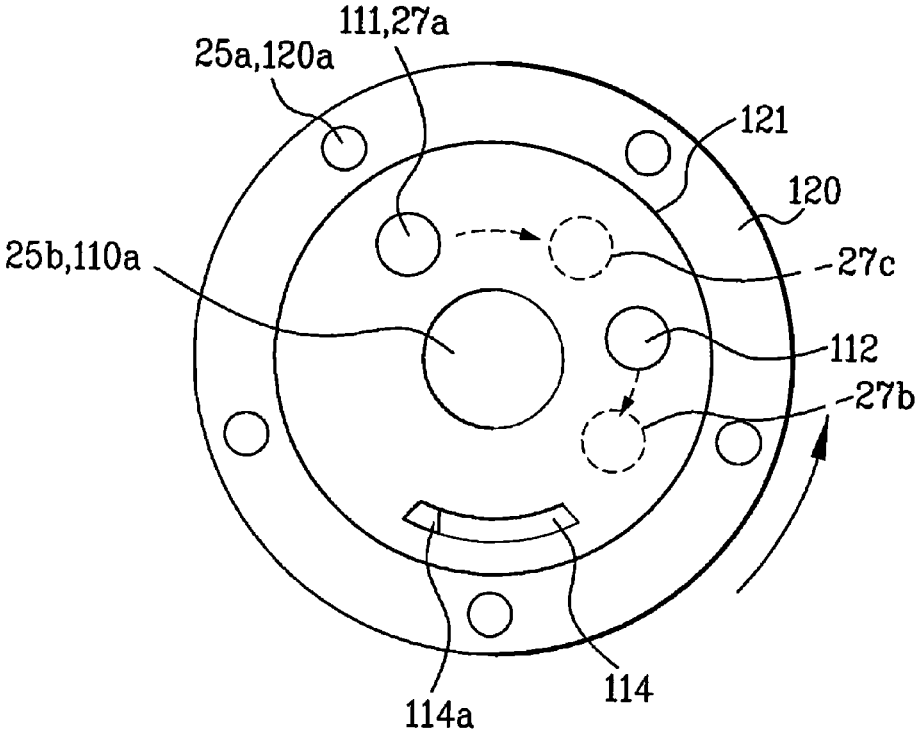
FIGS. 8A and 8B are plan views illustrating a revolution control means.
Figure 8B:
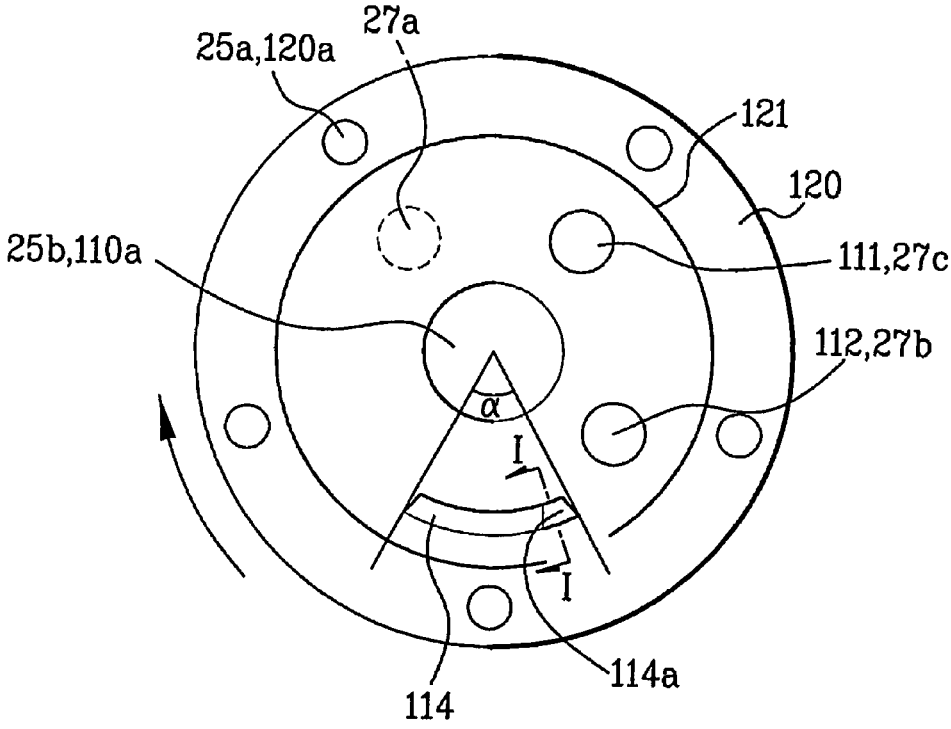
Figure 8C:
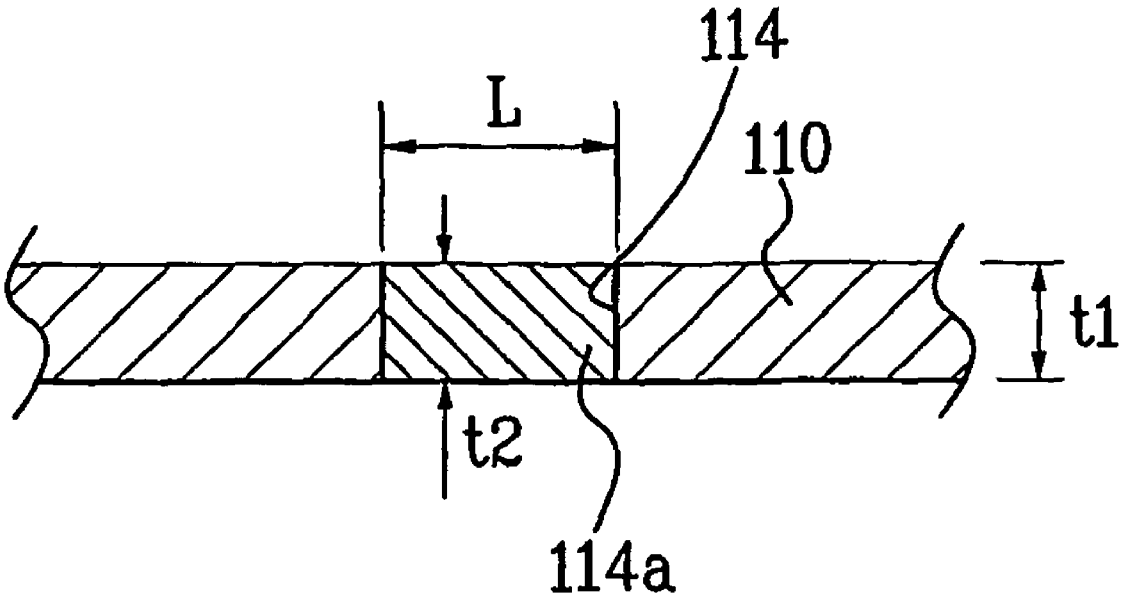
FIG. 8C is a partial sectional view of FIG. 8B.

As shown in FIGS. 8A and 8B, the control means includes a groove 114 formed at the first valve and having a predetermined length, and a stopper 114*a* formed on the second bearing 25 and inserted into the groove 114. The groove 114 and the stopper 114*a* are illustrated in FIGS. 5A, 5B and 6. The groove 114 serves as locus of the stopper 114*a* and can be a straight groove or a curved groove. If the groove 114 is exposed to the chamber 29 during operation, it becomes a dead volume causing a re-expansion of fluid. Accordingly, it is desirable to make the groove 114 adjacent to a center of the first valve 110 so that large portion of the groove 114 can be covered by the revolving roller 22. Preferably, an angle (α) between both ends of the groove 114 is of 30-120° in the center of the first valve 110. In addition, if the stopper 114*a* is protruded from the groove 114, it is interfered with the roller 22. Accordingly, it is desirable that a thickness T2 of the stopper 114*a* is equal to a thickness T1 of the valve 110, as shown in FIG. 8C. Preferably, a width L of the stopper 114*a* is equal to a width of the groove 114, such that the first valve rotates stably.

In the case of using the control means, the first valve 110 rotates counterclockwise together with the eccentric portion 13*a* of the driving shaft when the driving shaft 13 rotates counterclockwise. As shown in FIG. 8A, the stopper 114*a* is then latched to one end of the groove 114 to thereby stop the first valve 10. At this time, the first opening 111 accurately communicates with the first suction port 27*a*, and the second and third suction ports 27*b* and 27*c* are closed. As a result, fluid is introduced into the cylinder through the first suction port 27*a* and the first opening 111, which communicate with each other. On the contrary, if the driving shaft 13 rotates clockwise, the first valve 110 also rotates clockwise. At the same time, the first and second openings 111 and 112 also rotate clockwise, as represented with a dotted arrow in FIG. 8A. As shown in FIG. 8B, if the stopper 114*a* is latched to the other end of the groove 114, the first and second openings 111 and 112 are opened together with the third and second suction ports 27*c* and 27*b*. Then, the first suction port 27*a* is closed by the first valve 110. Accordingly, fluid is introduced through the second suction port 27*b*/the second opening 112 and the third suction port 27*c*/the first opening 111, which communicate with each other.

Figure 9A:
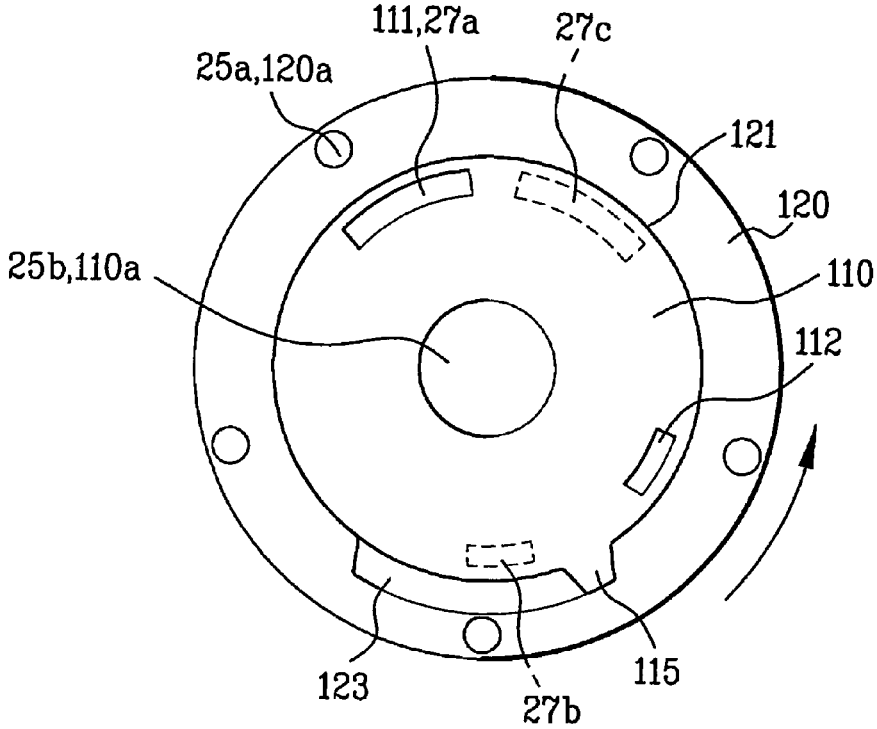
FIGS. 9A and 9B are plan views of modifications of a revolution control means.
Figure 9B:
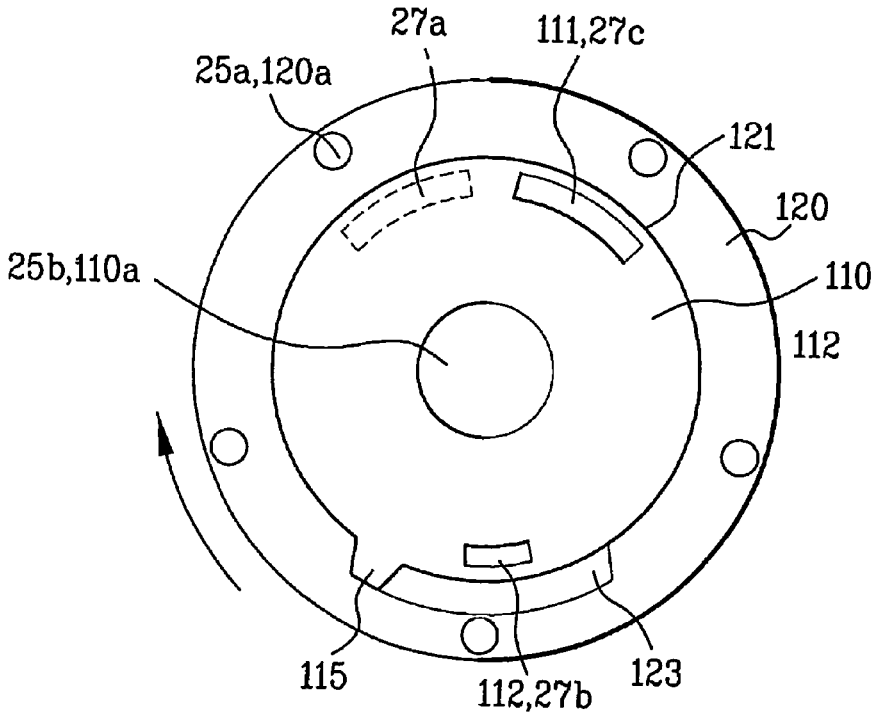

As shown in FIGS. 9A and 9B, the control means can be provided with a projection 115 formed on the first valve 110 and projecting in a radial direction of the first valve, and a groove 123 formed on the second valve 120 and receiving the projection movably. Here, the groove 123 is formed on the second valve 120 so that it is not exposed to the inner volume of the cylinder 21. Therefore, a dead volume is not formed inside the cylinder. In addition, as shown in FIGS. 10A and 10B, the control means can be provided with a projection 124 formed on the second valve 120 and projecting in a radial direction of the second valve 120, and a groove 116 formed on the first valve 110 and receiving the projection 124 movably.

Figure 10A:
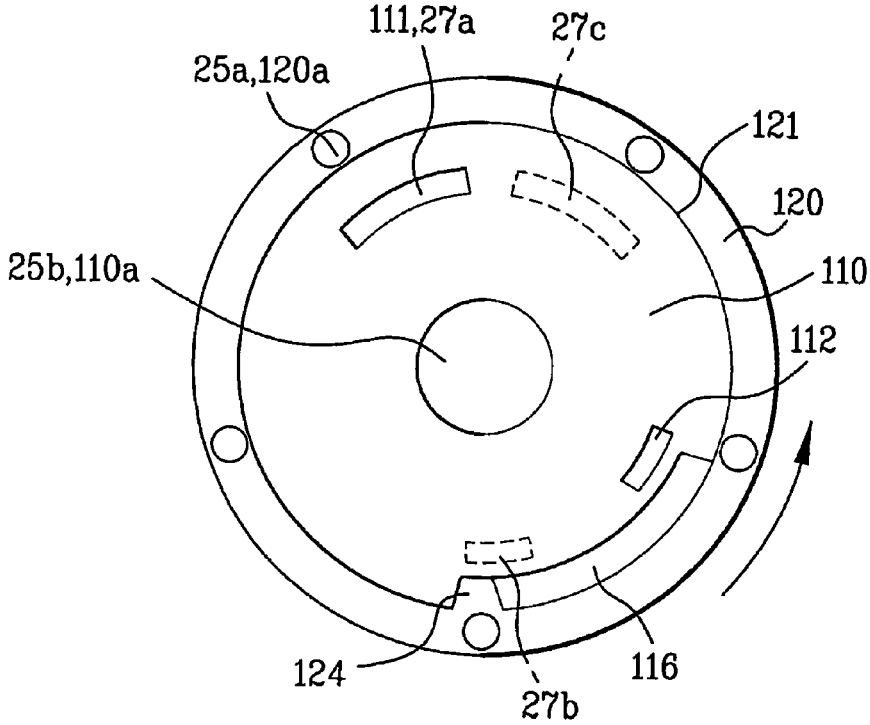
FIGS. 10A and 10B are plan views of another modification illustrating a revolution control means.
Figure 10B:
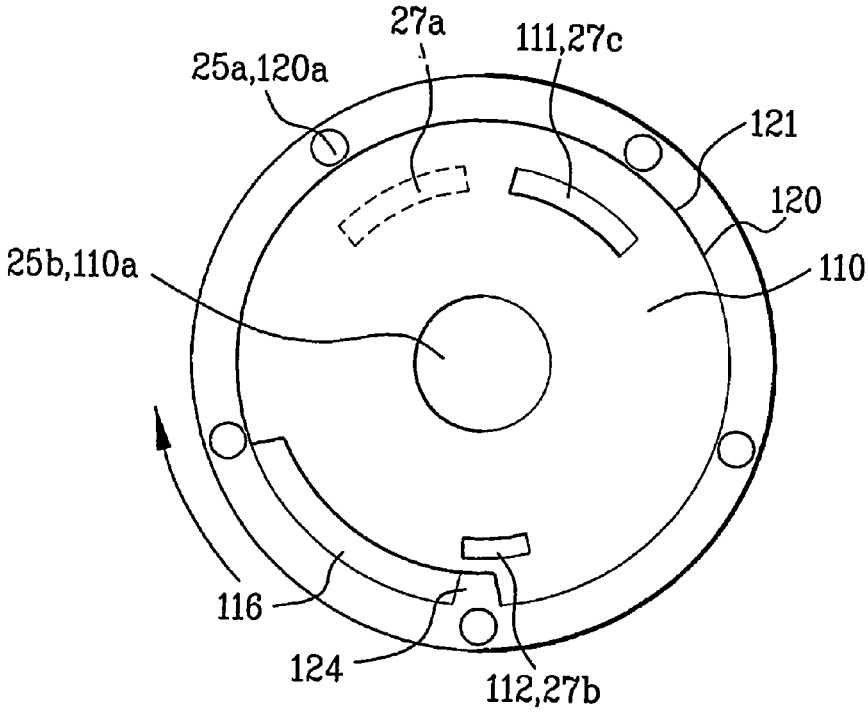

In the case of using such a control means, as shown in FIGS. 9A and 10A, the projections 115 and 124 are latched to one end of each groove 123 and 116 if the driving shaft 13 rotates counterclockwise. Accordingly, the first opening 111 communicates with the first suction port 27*a* so as to allow the suction of fluid, and the second and third suction ports 27*b* and 27*c* are closed. On the contrary, as shown in FIGS. 9B and 10B, if the driving shaft 13 rotates clockwise, the projections 115 and 124 are latched to the other end of each groove 123 and 116, and the first and second openings 111 and 112 simultaneously open the third and second suction ports 27*c* and 27*b* so as to allow the suction of fluid. The first suction port 27*a* is closed by the first valve 110.

Figure 11A:
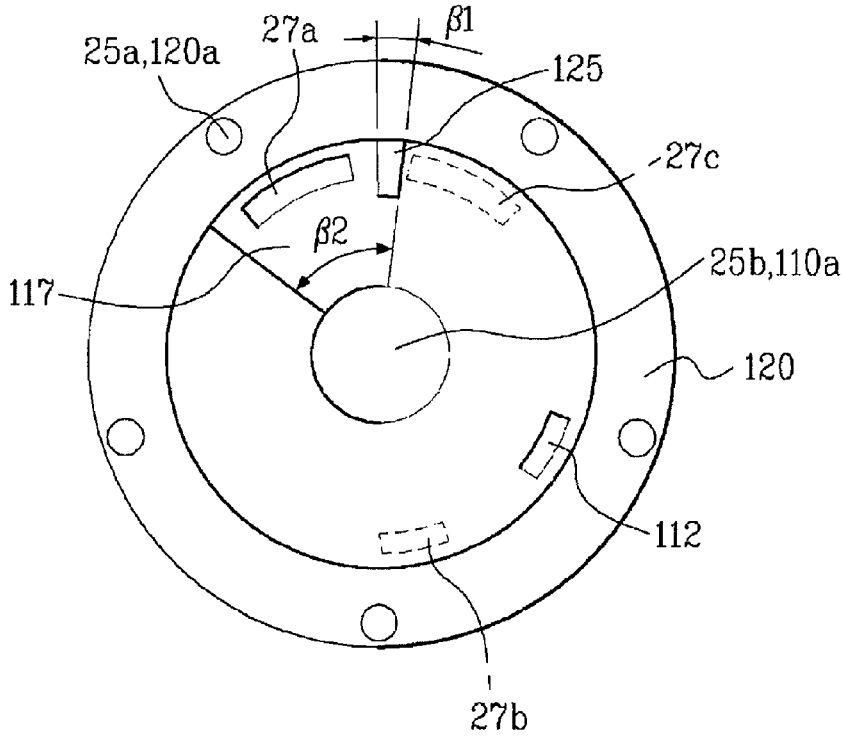
FIGS. 11A and 11B are plan views of another modified examples illustrating a revolution control means.
Figure 11B:
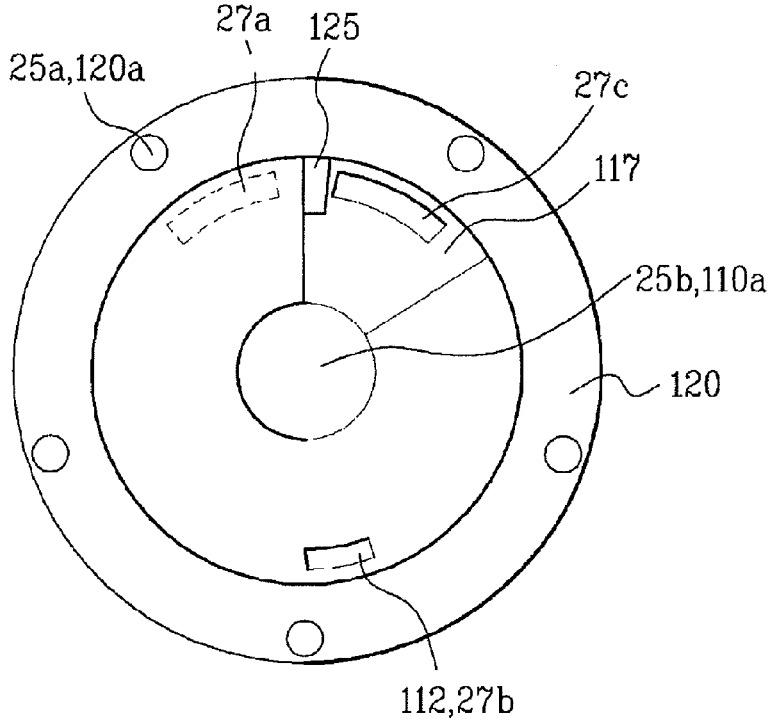

In addition, as shown in FIGS. 11A and 11B, the control means can be provided with a projection 125 formed on the second valve 120 and projecting toward a center of the second valve 120, and a cut-away portion 117 formed on the first valve 110 and receiving the projection 125 movably. In such a control means, a gap between the projection 125 and the cut-away portion 117 can open the first and second suction ports 27*a* and 27*b* by forming the cut-away portion 117 largely in a properly large size. Accordingly, the control means decreases substantially in volume since the grooves of the above-described control means are omitted.

In more detail, as shown in FIG. 11A, if the driving shaft 13 rotates counterclockwise, one end of the projection 125 contacts one end of the cut-away portion 17. Accordingly, a clearance between the other ends of the projection 125 and the cut-away portion 117 opens the first suction port 27*a*. In addition, as shown in FIG. 11B, if the driving shaft 13 rotates clockwise, the projection 125 is latched to the cut-away portion 117. At this time, the second opening 112 opens the second suction port 27*b*, and simultaneously, the clearance between the projection 125 and the cut-away portion 117 opens the third suction port 27*c* as described above. In such a control means, preferably, the projection 125 has an angle β1 of approximately 10° between both ends thereof and the cut-away portion 117 has an angle β2 of 30-120° between both ends thereof.

Hereinafter, operation of a rotary compressor according to the present invention will be described in more detail.

Hereinafter, there will be exemplarily described a rotary compressor structure in which the valve assembly 100 is installed so as not to be axially biased. In the meanwhile, although described later in detail, if a rotary compressor has the eccentric valve assembly, when the roller 22 is compressed clockwise in a rotary compressor in which the valve assembly 100 is installed so as not to be axially biased, occurrence of dead volume formed in the second opening 112 of the first valve 110, i.e., volume which is not compressed or volume which is not able to compress, can be prevented. Except for the aforementioned operation, since their operations are the same, remaining operation of the rotary compressor provided with the eccentric valve assembly will be replaced by the following description.

Figure 12A:
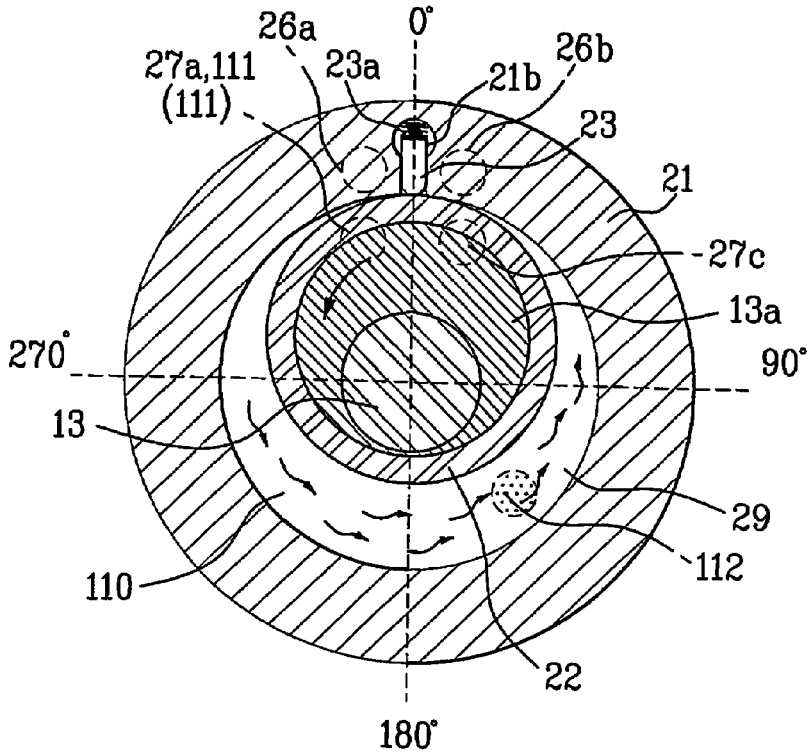
FIGS. 12A to 12C are cross-sectional views sequentially illustrating insides of the cylinder when the roller revolves in the counterclockwise direction in the compressors of FIGS. 2 and 3.
Figure 12B:
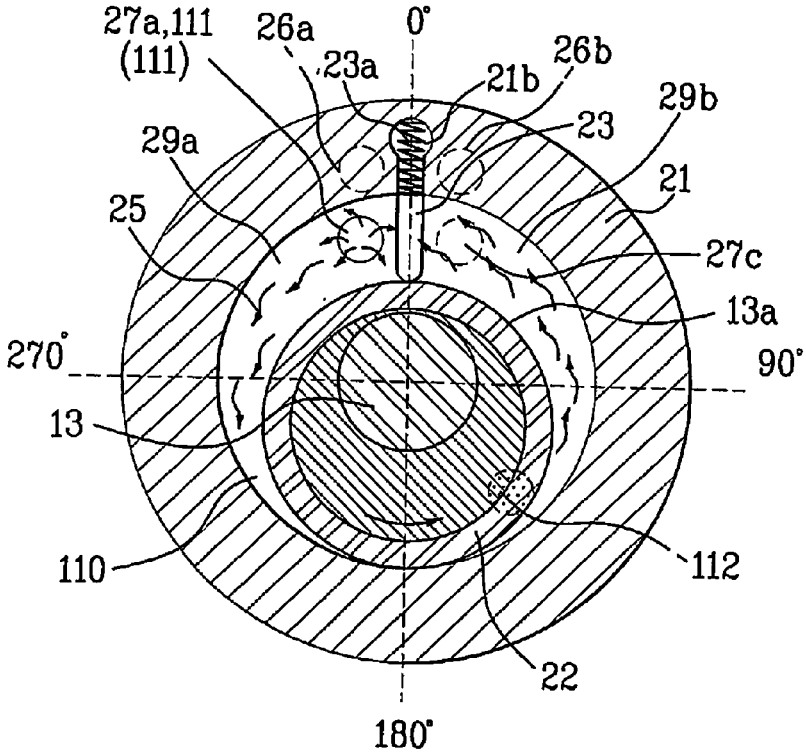
Figure 12C:
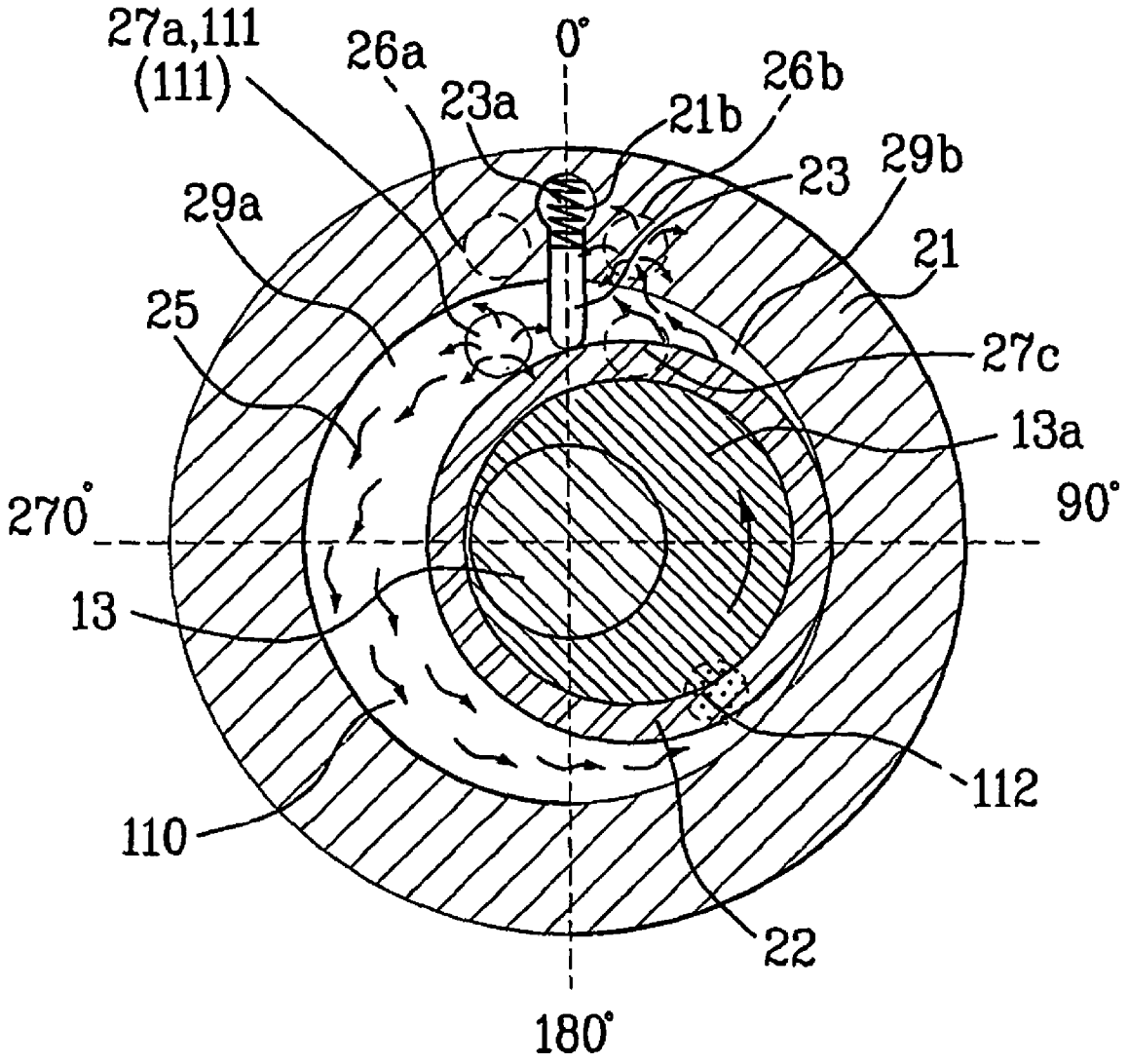

FIGS. 12A to 12C are cross-sectional views illustrating an operation of the rotary compressor when the roller revolves in the counterclockwise direction. Symbols in parenthesis in FIGS. 12A to 12C are indicative of elements shown in the present viewpoint.

First, in FIG. 12A, there are shown states of respective elements inside the cylinder when the driving shaft 13 rotates in the counterclockwise direction. First, the first suction port 27*a* communicates with the first opening 111, and the remainder second suction port 27*b* and third suction port 27*c* are closed. Detailed description on the state of the suction ports in the counterclockwise direction will be omitted since it has been described with reference to FIGS. 8A, 9A, 10A and 11A.

In a state that the first suction port 27*a* is opened (the state that the first opening 111 is communicated), the roller 22 revolves counterclockwise with performing a rolling motion along the inner circumference of the cylinder 21 due to the rotation of the driving shaft 13. At this time, the fluid introduced into the fluid chamber 29 through the first suction port 27*a* is filled even in the inner space of the second opening 112 of the first valve 110. In other words, in case the roller 22 rotates counterclockwise, the second opening 112 has an inner space corresponding to the thickness of the first valve 110 and the plane area of the second opening 112. Hence, when the roller 22 compresses fluid with rotating counterclockwise, the fluid is filled even in the inner space of the second opening 112.

As the roller 22 continues to revolve in a state that the inside of the second opening 112 is full of fluid, the size of the space 29*b* is reduced as shown in FIG. 12B and thus the fluid that has been sucked is compressed. In this stroke, the vane 23 moves up and down elastically by the elastic member 23*a* to thereby hermetically partition the fluid chamber 29 into the two sealed spaces 29*a* and 29*b*. At the same time, new fluid continues to be sucked into the space 29*a* through the first suction port 27*a* (first opening 111) so as to be compressed in a next stroke. At this time, as shown in FIG. 12B, the opened upper portion of the second opening 112 is closed by the eccentric portion 13*a* of the driving shaft 13 and the lower surface of the roller 22. Accordingly, the fluid filled at a full level in the second opening 112 is confined. The fluid which is confined in the second opening 112 is a volume that is not able to compress, called "dead volume". Influence of the dead volume will be described later.

When the fluid pressure in the space 29*b* is above a predetermined value, the second discharge valve 26*d* shown in FIG. 2 is opened. Accordingly, as shown in FIG. 12C, the fluid is discharged through the second discharge port 26*b*. As the roller 22 continues to revolve, all the fluid in the space 29*b* is discharged through the second discharge port 26*b*. After the fluid is completely discharged, the second discharge valve 26*d* closes the second discharge port 26*c* by its self-elasticity. And, if the roller 22 further rotates, the second opening 112 communicates with the fluid chamber 29, so that the confined fluid is mixed with other fluid newly supplied into the fluid chamber 29. At this time, since the two kinds of fluids have different pressures, noise and vibration are caused as soon as the second opening 112 communicates with the fluid chamber 29.

Thus, after a single stroke is ended, the roller 22 continues to revolve counterclockwise and discharges the fluid by repeating the same stroke. In the counterclockwise stroke, the roller 22 compresses the fluid with revolving from the first suction port 27*a* (the first opening 111) to the second discharge port 26*b*. As aforementioned, since the first suction port 27*a* (the first opening 111) and the second discharge port 27*b* are positioned in the vicinity of the vane 23 to face each other, the fluid is compressed using the overall volume of the fluid chamber 29 in the counterclockwise stroke, so that a maximal compression capacity is obtained.

Figure 13A:
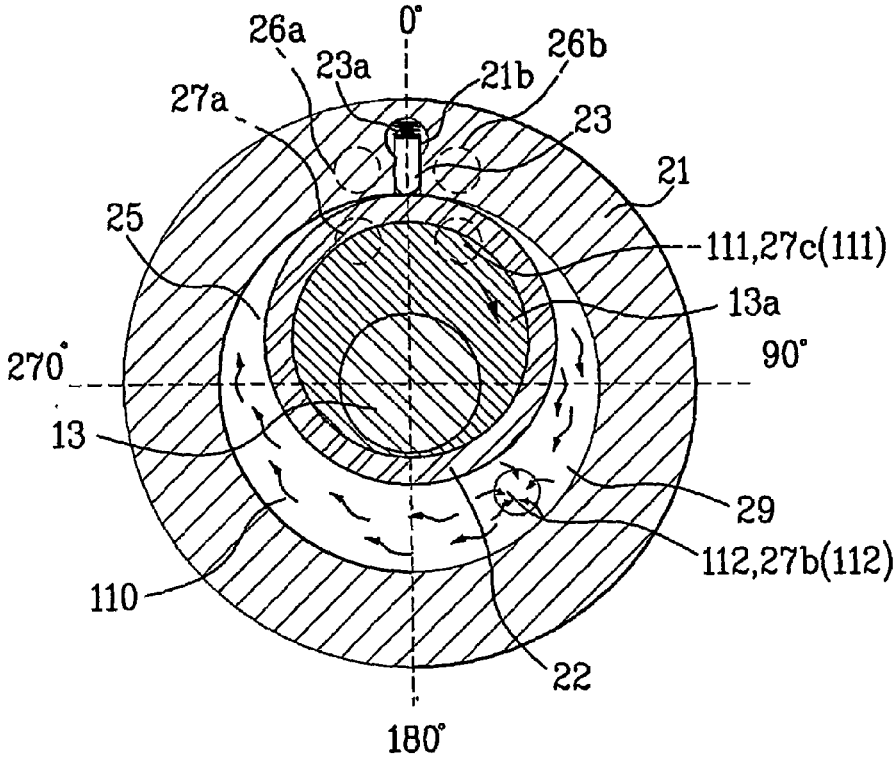
FIG. 13A to 13C are cross-sectional views sequentially illustrating insides of the cylinder when the roller revolves in the clockwise direction in the compressors of FIGS. 2 and 3.
Figure 13B:
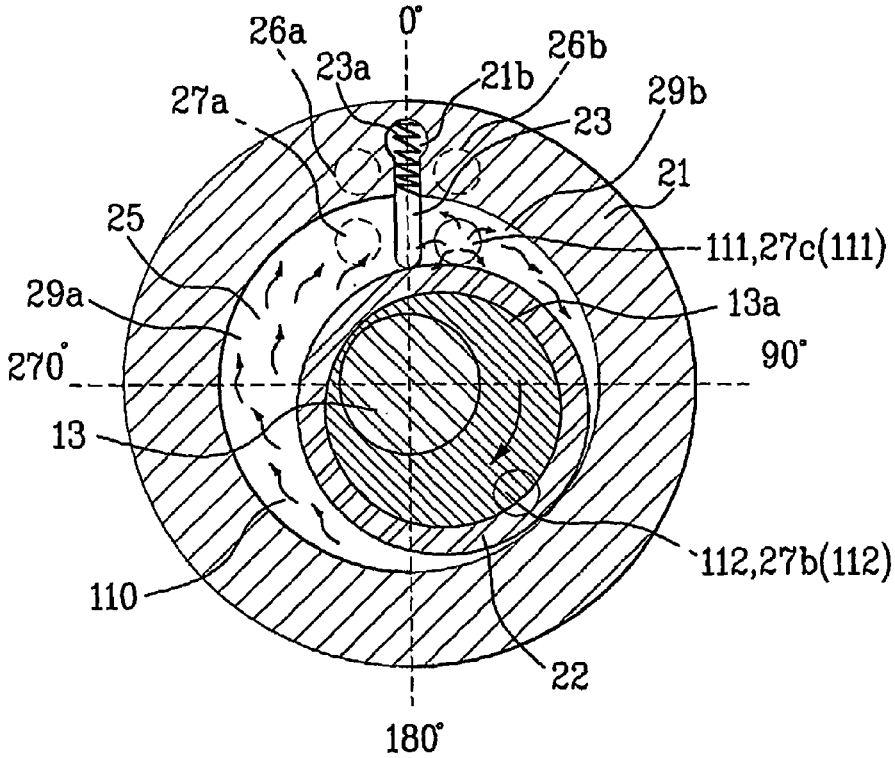
Figure 13C:
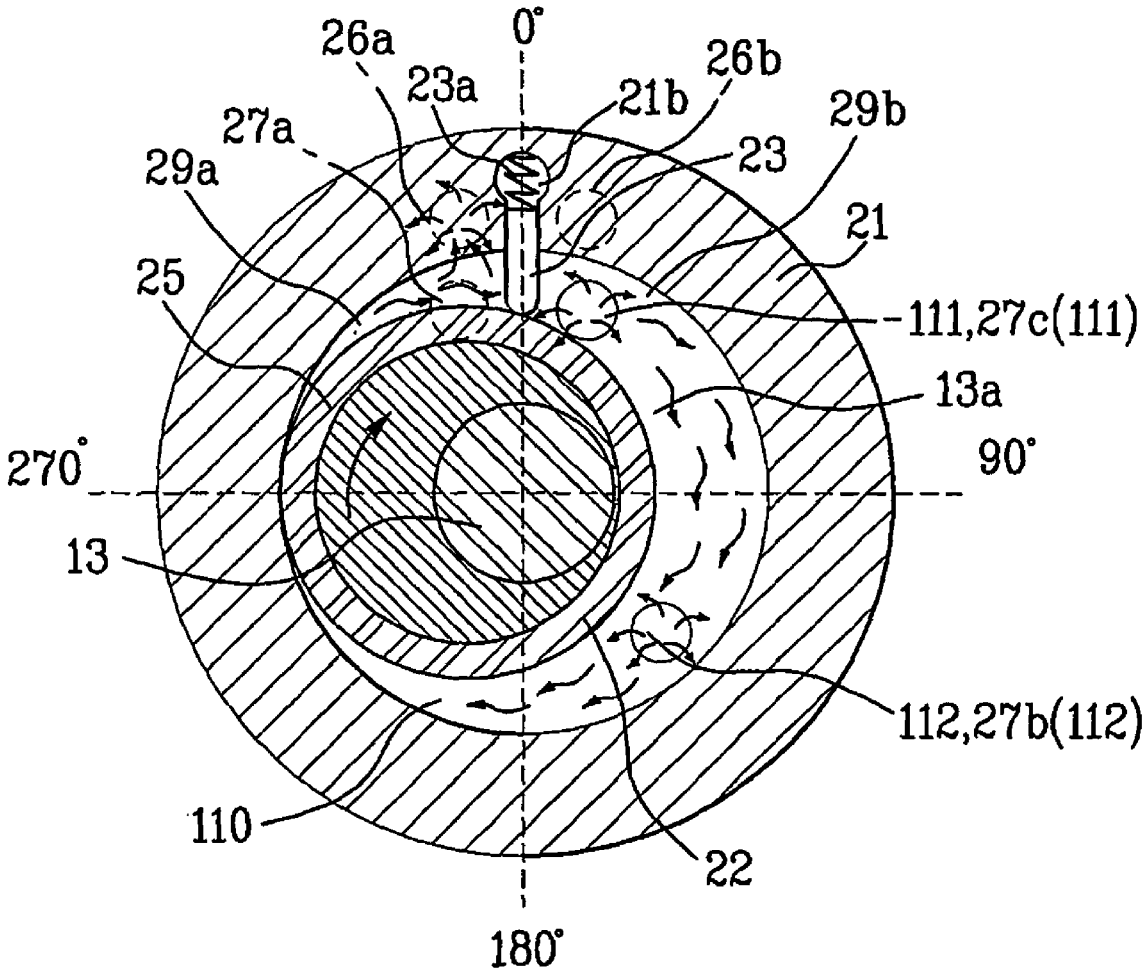

FIGS. 13A to 13C are cross-sectional views an operation sequence of a rotary compressor according to the present invention when the roller revolves clockwise.

First, in FIG. 13A, there are shown states of respective elements inside the cylinder when the driving shaft 13 rotates in the clockwise direction. The first suction port 27*a* is closed, and the second suction port 27*b* and third suction port 27*c* communicate with the second opening 112 and the first opening 111 respectively. If the first valve 110 has the third opening 113 additionally (refer to FIG. 6), the third suction port 27*c* communicates with the third opening 113. Detailed description on the state of the suction ports in the clockwise direction will be omitted since it has been described with reference to FIGS. 8B, 9B, 10B and 11B.

In a state that the second and third suction ports 27*b* and 27*c* are opened (i.e., a state that the first and second openings 111 and 112 communicate), the roller 22 begins to revolve clockwise with performing a rolling motion along the inner circumference of the cylinder due to the clockwise rotation of the driving shaft 13. In such an initial stage revolution, the fluid sucked until the roller 22 reaches the second suction port 27*b* (second opening 112) is not compressed but is forcibly exhausted outside the cylinder 21 by the roller 22 through the second suction port 27*b* (second opening 112) as shown in FIG. 13A. Accordingly, the fluid begins to be compressed after the roller 22 passes the second suction port 27*b* (second opening 112) as shown in FIG. 13B. At the same time, a space between the second suction port 27*b* (second opening 112) and the vane 23, i.e., the space 29*b* is made in a vacuum state. However, as aforementioned, as the revolution of the roller 22 starts, the third suction port 27*c* communicates with the first opening 111 (or third opening 113) and thus is opened so as to suck the fluid.

As the roller 22 continues to revolve, the size of the space 29*a* is reduced and the fluid that has been sucked is compressed. In this compression stroke, the vane 23 moves up and down elastically by the elastic member 23*a* to thereby partition the fluid chamber 29 into the two sealed spaces 29*a* and 29*b*. Also, new fluid is continuously sucked into the space 29*b* through the second and third suction ports 27*b* and 27*c* (first and second openings 111 and 112) so as to be compressed in a next stroke.

When the fluid pressure in the space 29*a* is above a predetermined value, the first discharge valve 26*c* is opened as shown in FIG. 13C and accordingly the fluid is discharged through the first discharge port 26*a*. After the fluid is completely discharged, the first discharge valve 26*c* closes the first discharge port 26*a* by its self-elasticity.

Thus, after a single stroke is ended, the roller 22 continues to revolve clockwise and discharges the fluid by repeating the same stroke. In the counterclockwise stroke, the roller 22 compresses the fluid with revolving from the second suction port 27*b* (second opening 112) to the first discharge port 26*a*. Accordingly, the fluid is compressed using a part of the overall fluid chamber 29 in the counterclockwise stroke, so that a compression capacity smaller than the compression capacity in the clockwise direction is obtained.

In the aforementioned strokes (i.e., the clockwise stroke and the counterclockwise stroke), the discharged compressive fluid moves upward through the space between the rotor 12 and the stator 11 inside the case 1 and the space between the stator 11 and the case 1. As a result, the compressed fluid is discharged through the discharge tube 9 out of the compressor.

In the meanwhile, as aforementioned, when a maximum capacity is obtained by compressing the fluid while the roller 22 rotates counterclockwise, a dead volume is generated in the fluid chamber 29. Thus, if the dead volume is generated in the fluid chamber 29, the compressor fails to compress the fluid by using all the volume existing in the fluid chamber 29 from the first suction port 27*a* to the second discharge port 26*b*, so that loss in the compression capacity is caused. In order to compensate for the loss in the compression capacity caused by the dead volume, it is requested to design size, diameter and height of the cylinder 21 with margins, which brings to lower the economic efficiency. In the meanwhile, the driving shaft 13 and the roller 22 rotate at a considerably fast speed. Hence, if the dead volume where uncompressed fluid is kept indoors exists, there occurs abrupt variation in pressure at the roller 22 and a lower side of the eccentric portion 13*a* while the roller 22 rotates. The abrupt variation in pressure acts as a load hindering the rotation of the driving shaft 22 to cause vibration and noise. Hence, it is strongly requested to design it compensatively.

Figure 14:
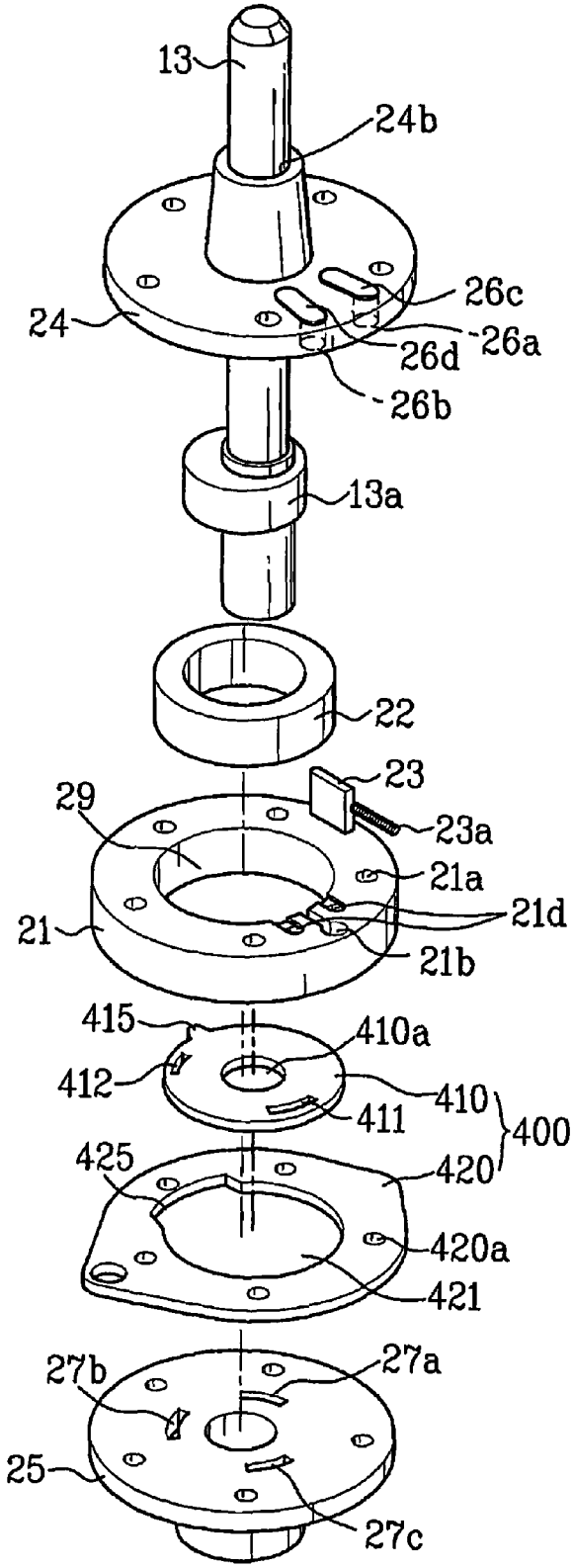
FIG. 14 is an exploded perspective view illustrating a compressing unit of a rotary compressor provided with an axially biased valve assembly according to the present invention.

To solve the aforementioned dead volume, the invention, as shown in FIG. 14, provides a compressor in which a valve assembly 400 is eccentrically installed with respect to the cylinder 21. Since the structure of the compressor shown in FIG. 14 according to the invention is the same as that of the compressor described with reference to FIG. 2 except for the eccentric installation structure of the valve assembly 400, structure and operation of the compressor provided with the valve assembly 400 which is eccentrically installed with respect to the cylinder 21 will be described hereinafter.

Figure 15A:
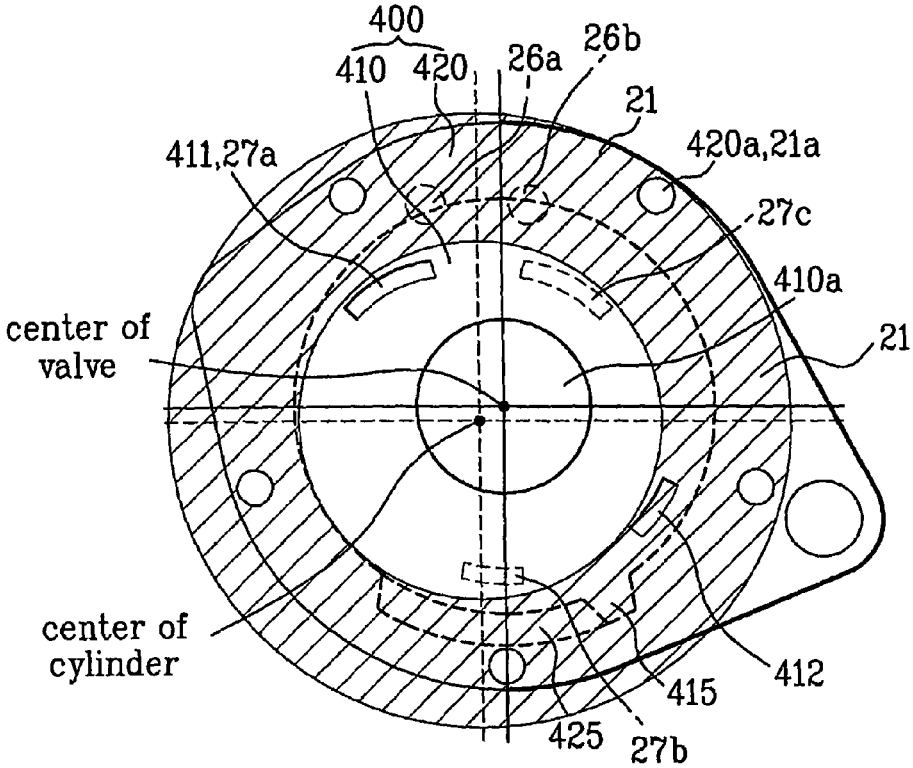
FIG. 15A is a cross-sectional view illustrating an inner structure of the cylinder when the roller revolves clockwise in the compressor of FIG. 14.
Figure 15B:
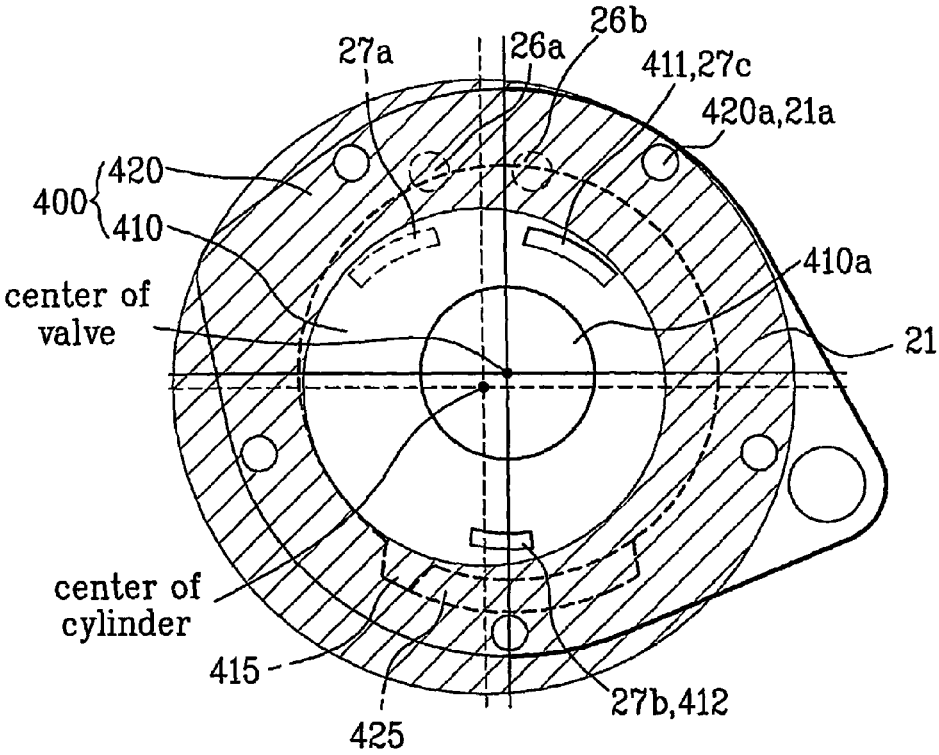
FIG. 15B is a cross-sectional view illustrating an inner structure of the cylinder when the roller revolves counterclockwise in the compressor of FIG. 14.

FIG. 15A is a cross-sectional view illustrating an inner structure of the cylinder when the roller revolves clockwise in the compressor of FIG. 14, and FIG. 15B is a cross-sectional view illustrating an inner structure of the cylinder when the roller revolves counterclockwise in the compressor of FIG. 14. In FIGS. 15A and 15B, there are not shown the roller 22 and the driving shaft 13 so as to clearly show the locations of the respective openings. Referring to FIG. 14, the valve assembly 400 includes a first valve 410 and a second valve 420. Since the structure of the valve assembly 400 is substantially the same as that of the valve assembly 100 described above, its detailed description is omitted and only differences will be described.

As sown in FIG. 14 to FIG. 15*b*, the valve assembly 400 is installed between the cylinder 21 and the second bearing 25 so as to have a center spaced apart by a predetermined distance from the center of the cylinder 21, i.e., the rotational center of the driving shaft 13. For this, a penetration hole 410*a* of the first valve 410 of the eccentrically installed valve assembly 400 is formed larger than the penetration hole 110*a* of the first valve 110 of the valve assembly that is installed non-eccentrically. In other words, the penetration hole 110*a* is the same as the outer diameter of the driving shaft 13 or has a diameter that is slightly larger than the outer diameter of the driving shaft 13, whereas the penetration hole 410*a* is formed to be larger than the penetration hole 110*a* by a distance which the center of the valve assembly 400 is biased from the center of the cylinder 21. This is because the eccentrically installed valve assembly 400 needs an additional space corresponding to the axially biased distance so as not to restrain the driving shaft 13 during rotation of the driving shaft 13 such that the valve assembly 400 has the same structure as the valve assembly 100 and the center of the valve assembly 400 is not axially biased from the center of the cylinder 21 and the driving shaft 13.

When the valve assembly 400 is installed to be axially biased from the center of the cylinder 21, inner appearance thereof is shaped as shown in FIGS. 15A and 15B. As shown in these drawings, the size of the first valve 41 has to be smaller than the inner diameter of the cylinder 21, i.e., the diameter of the fluid chamber 29. When the first valve 410 rotates clockwise or counterclockwise, the outer circumference of the first valve 410, i.e., a site portion 421 of the second valve 420 is positioned outside the fluid chamber 29. Only if installing the valve assembly as aforementioned, the fluid is not leaked although the first valve 410 rotates in either clockwise direction or counterclockwise direction.

In the meanwhile, the first valve 410 rotates around a center spaced apart by a predetermined distance from the center of the cylinder 21. Accordingly, the second opening 412 formed in the first valve 410 is positioned inside the fluid chamber 29 to feed fluid into the fluid chamber 29 depending on the rotational direction of the first valve 410 or is positioned outside the fluid chamber 29 to prevent the dead volume described as above. The first opening 411 is always positioned inside the cylinder 21 regardless of the rotational direction of the cylinder 21, and it communicates with the first suction port 27*a* or the third suction port 27*c* depending on the rotational direction to introduce the fluid into the fluid chamber 29. Hereinafter, operation of the first valve 410 depending on the rotational direction will be described in more detail.

Referring to FIG. 15A, when the roller 22 rotates counterclockwise, the first opening 411 of the first valve 410 communicates with the first suction port 27*a* of the second bearing 25. The second opening 412 performs the same role as the second opening 112 generating the dead volume in the valve assembly that is installed non-eccentrically, and is positioned outside the fluid chamber 29 as shown in FIG. 15A. Herein, the rotational angle of the first valve 410 is restricted by a protrusion 415 and a groove 425. If the first valve 410 is positioned as above, the fluid is introduced into the fluid chamber 29 through the first opening 411 when the roller 22 rotates counterclockwise. The roller 22 compresses the fluid with continuing to rotate counterclockwise, and the compressed fluid is discharged through the second discharge port 26*b*. At this point, since the second opening 412 is positioned inside the fluid chamber 29, the dead volume is not generated, so that it becomes possible to use the maximal compressive volume in full.

Referring to FIG. 15B, if the roller 22 in the state of FIG. 15A rotates clockwise about the center of the cylinder 21, the first valve 410 rotates about the center of the valve axially biased by a predetermined distance from the center of the cylinder, so that the second opening 412 moves from the outside of the fluid chamber 29 to the inside of the fluid chamber 29 as shown in FIG. 15B. Thus, the moved second opening 412 communicates with the second suction port 27*b* to guide the fluid into the fluid chamber 29. The first opening 411 also moves and finally communicates with the third suction port 27*c* to guide the fluid into the fluid chamber 29. Since the compression and discharge strokes after the guidance of the fluid are the same as those described with reference to FIGS. 13A to 13C, their detailed description will be omitted.

Thus, in the inventive compressor in which the valve assembly 400 is eccentrically installed from the center of the cylinder 21, the second opening 412 is positioned inside the fluid chamber 29 while the first valve 410 rotates counter-clockwise, so that dead volume is not generated. Hence, the use of the inventive compressor prevents the compression volume from being lost upon outputting a maximum capacity so that more power can be outputted in the same sized compressor as the conventional one.

Figure 16:
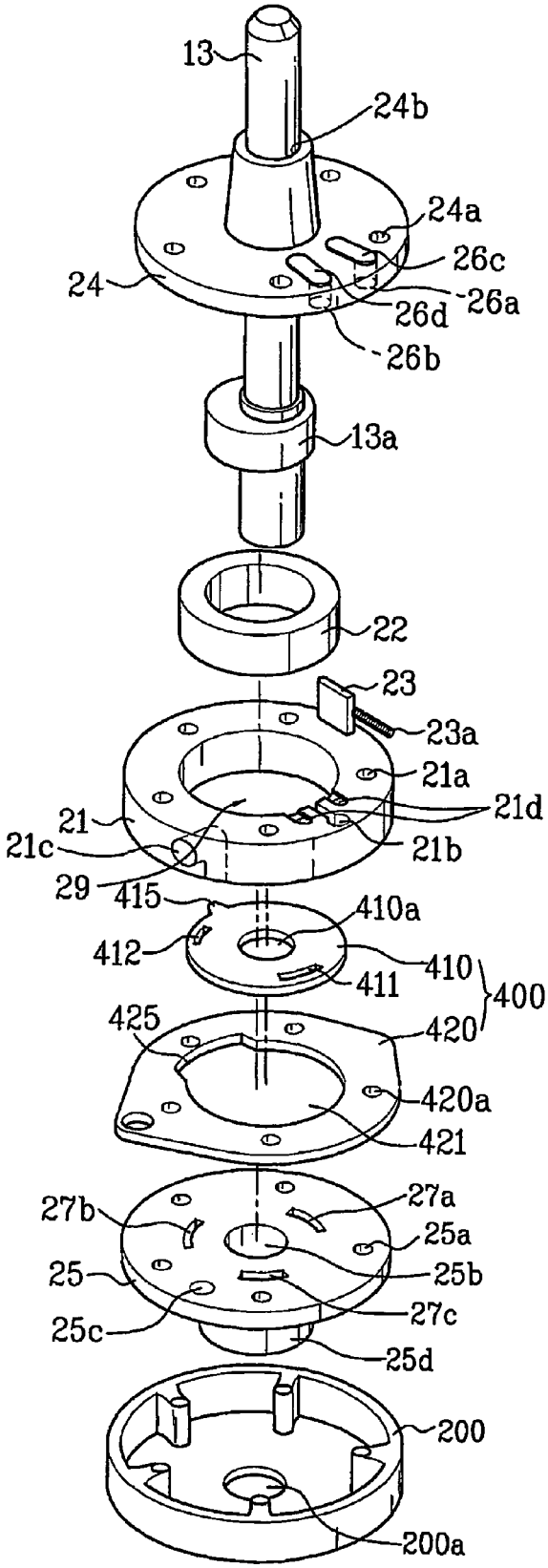
FIG. 16 is an exploded perspective view of a compressing unit of a compressor provided with an axially biased valve assembly including a suction plenum according to the present invention.
Figure 17:
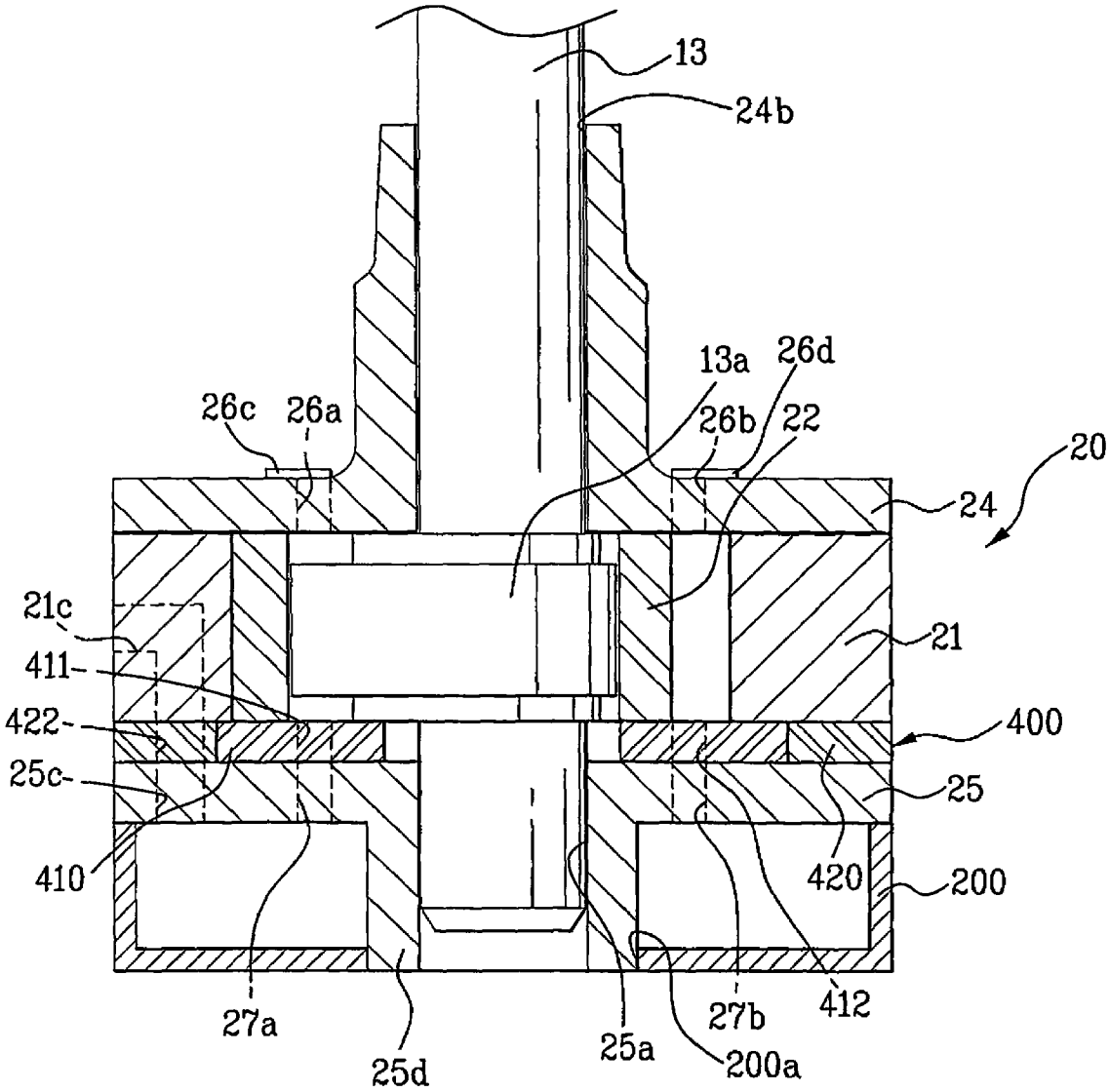
FIG. 17 is a sectional view illustrating the compressing unit of FIG. 16.

Meanwhile, as described above with reference to FIG. 1, the suction ports 27*a*, 27*b* and 27*c* are individually connected with a plurality of suction pipes 7*a* so as to supply fluid to the fluid chamber 29 installed inside the cylinder 21. However, the number of parts increases due to these suction pipes 7*a*, thus making the structure complicated. In addition, fluid may not be supplied properly to the cylinder 21 due to a change in a compression state of the suction pipes 7*b* separated during operation. Accordingly, as shown in FIGS. 16 and 17, it is desirable to include a suction plenum 200 for preliminarily storing fluid to be sucked by the compressor.

The suction plenum 200 directly communicates with all of the suction ports 27*a*, 27*b* and 27*c* so as to supply the fluid. Accordingly, the suction plenum 200 is installed in a lower portion of the second bearing 25 in the vicinity of the suction ports 27*a*, 27*b* and 27*c*. Although there is shown in the drawing that the suction ports 27*a*, 27*b* and 27*c* are formed at the second bearing 25, they can be formed at the first bearing 24 if necessary. In this case, the suction plenum 200 is installed in the first bearing 24. The suction plenum 200 can be directly fixed to the bearing 25 by a welding. Alternatively, a coupling member can be used to couple the suction plenum 200 with the cylinder 21, the first and second bearings 24 and 25 and the valve assembly 100. In order to lubricate the driving shaft 13, a sleeve 25*d* of the second bearing 25 should be soaked into a lubricant which is stored in a lower portion of the case 1. Accordingly, the suction plenum 200 includes a penetration hole 200*a* for the sleeve. Preferably, the suction plenum 200 has one to four times a volume as large as the fluid chamber 29 so as to supply the fluid stably. The suction plenum 200 is also connected with the suction pipe 7 so as to store the fluid. In more detail, the suction plenum 200 can be connected with the suction pipe 7 through a predetermined fluid passage. In this case, as shown in FIG. 12, the fluid passage penetrates the cylinder 21, the valve assembly 100 and the second bearing 25. In other words, the fluid passage includes a suction hole 21*c* of the cylinder 21, a suction hole 122 of the second valve, and a suction hole 25*c* of the second bearing.

Such the suction plenum 200 forms a space in which a predetermined amount of fluid is always stored, so that a compression variation of the sucked fluid is buffered to stably supply the fluid to the suction ports 27*a*, 27*b* and 27*c*. In addition, the suction plenum 200 can accommodate oil extracted from the stored fluid and thus assist or substitute for the accumulator 8.

Meanwhile, although the suction plenum 200 is used, since the number of the components is not reduced greatly, the production cost is increased and the productivity may be lowered. On this reason, one second bearing 300 including the functions of the suction plenum 200 is preferably substituted for the suction plenum 200. The second bearing 300 is configured to support the driving shaft rotatably and preliminarily store the fluid to be sucked. Referring to associated drawings, the second bearing 300 will be described in more detail.

Figure 18:
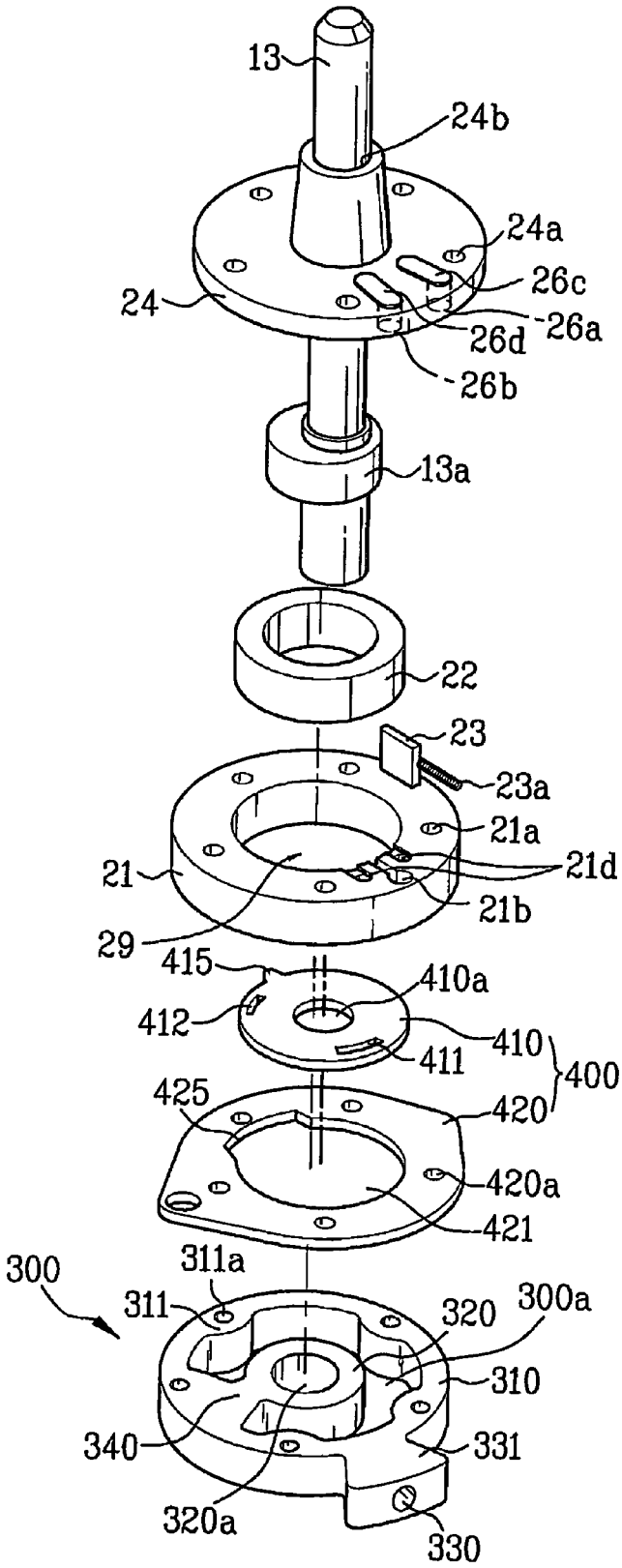
FIG. 18 is an exploded perspective view of a compressing unit of a compressor provided with an axially biased valve assembly including a deformed second bearing according to the present invention.
Figure 19:
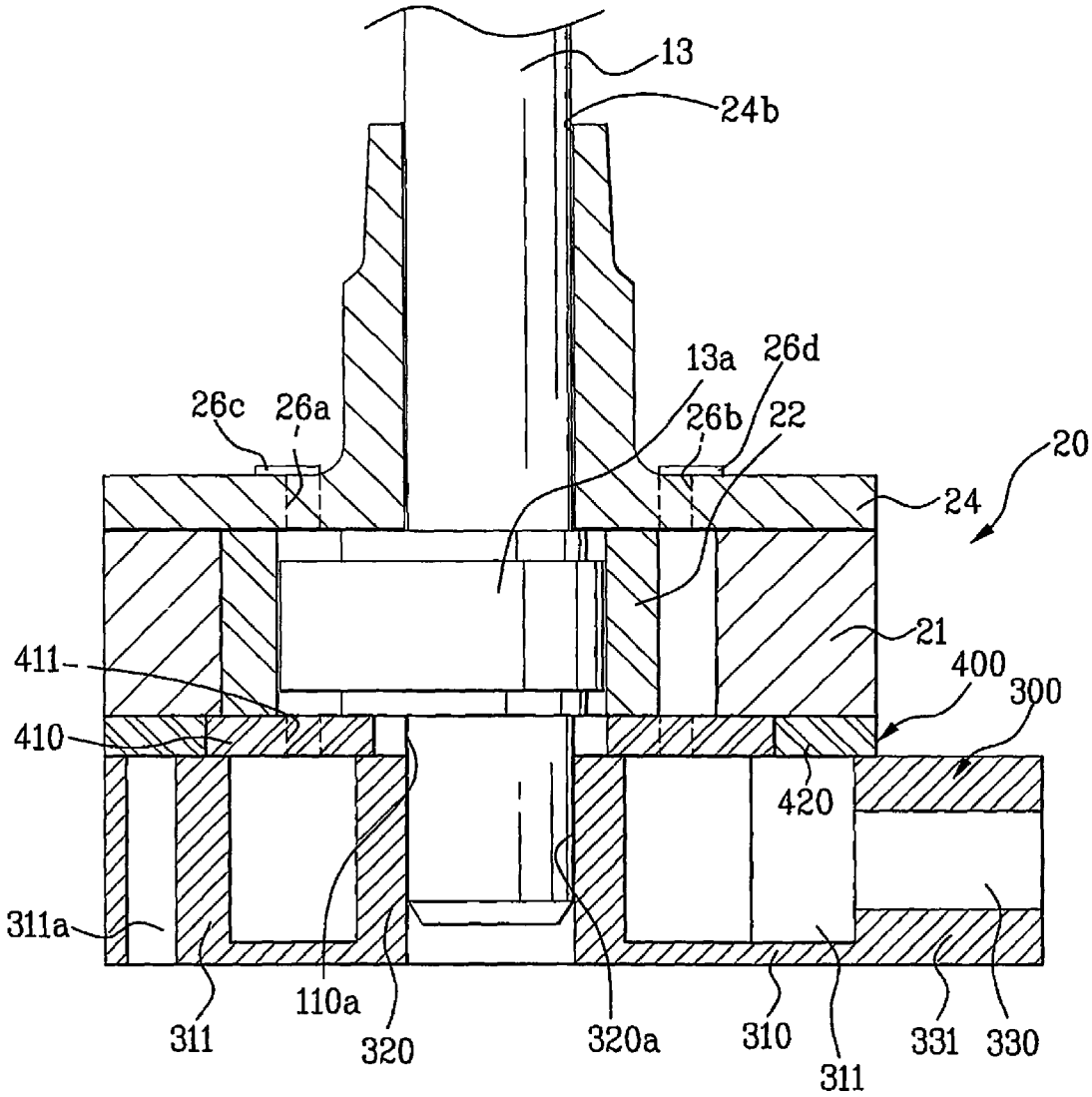
FIG. 19 is a sectional view illustrating the compressing unit of FIG. 18.

FIGS. 18 and 19 are an exploded perspective view and a cross-sectional view illustrating a compressing unit of a rotary compressor including a second bearing. FIG. 16 is a plan view of the second bearing.

As shown in the drawings, the second bearing 300 includes a body 310 and a sleeve 320 formed inside the body 310. The body 310 is a container that has a predetermined inner space to store the fluid. The inner space has preferably 100-400% a volume as large as the fluid chamber 29 so as to stably supply the fluid like the suction plenum 200. While the fluid is stored, the lubricant is separated from the fluid and is accommodated in the inner space, more precisely, in the bottom surface of the body 310. In addition, as described above, since the upper portion of the body 310 is opened, a single opening 300*a* is substantially formed and also partly performs the function as the flow passage to supply the fluid of the discharge ports 27*a*, 27*b* and 27*c*. In other words, the second bearing 300 is formed on the upper portion of the body 310 and has one suction port 300*a* communicating continuously with the openings 411 and 412 of the valve assembly 400. The sleeve 320 supports the driving shaft 13 rotatably. In other words, the driving shaft 13 is rotatably inserted into a penetration hole 320*a* formed in the sleeve 320.

For the valve assembly 400, especially, the first valve 410 to rotate along with the driving shaft 13, the valve assembly 400 should be supported by a predetermined member. In the embodiment shown in FIGS. 1 through 13, the second bearing 25 supports the first valve 410. Accordingly, the modified second bearing 300 also includes a supporting unit for supporting the valve assembly 400. In the second bearing 300, an end of the sleeve 320 (that is, free end) supports the first valve 410 as shown in FIG. 15. More particularly, the sleeve 320 extends to contact the surface of the lower portion and supports the center area, that is, the peripheral portion of the penetration hole 410*a* relatively. In addition, a plurality of bosses 311 function to support the first valve 410. The bosses 311 are formed to make a coupling hole 311*a* basically. The second bearing 300 can be coupled with the valve assembly 400, the cylinder 21 and the first bearing 21 by using the coupling hole 311*a* and a coupling member. The bosses 311 are formed with a predetermined distance on the wall surface of the body, more particularly, on the inner circumference of the body 310 and accordingly the outer circumference of the first valve 410 is supported uniformly by the bosses 311. In the preceding embodiment, since the entire surface of the lower portion of the first valve 110 is supported by the second bearing 25, the contact area of them is large virtually. Accordingly, when the discharge ports 27*a*, 27*b*, 27*c* are selectively opened, the first valve 110 may not rotate smoothly. However, in the modified second bearing 300, the first valve 410 is partially supported by the sleeve 320 and the bosses 311 so that the contact area can be minimized. On the other hand, if the first valve rotates unstably due to this minimal supporting, the thickness of the sleeve 320 and the bosses 311 can be increased properly.

Figure 20A:
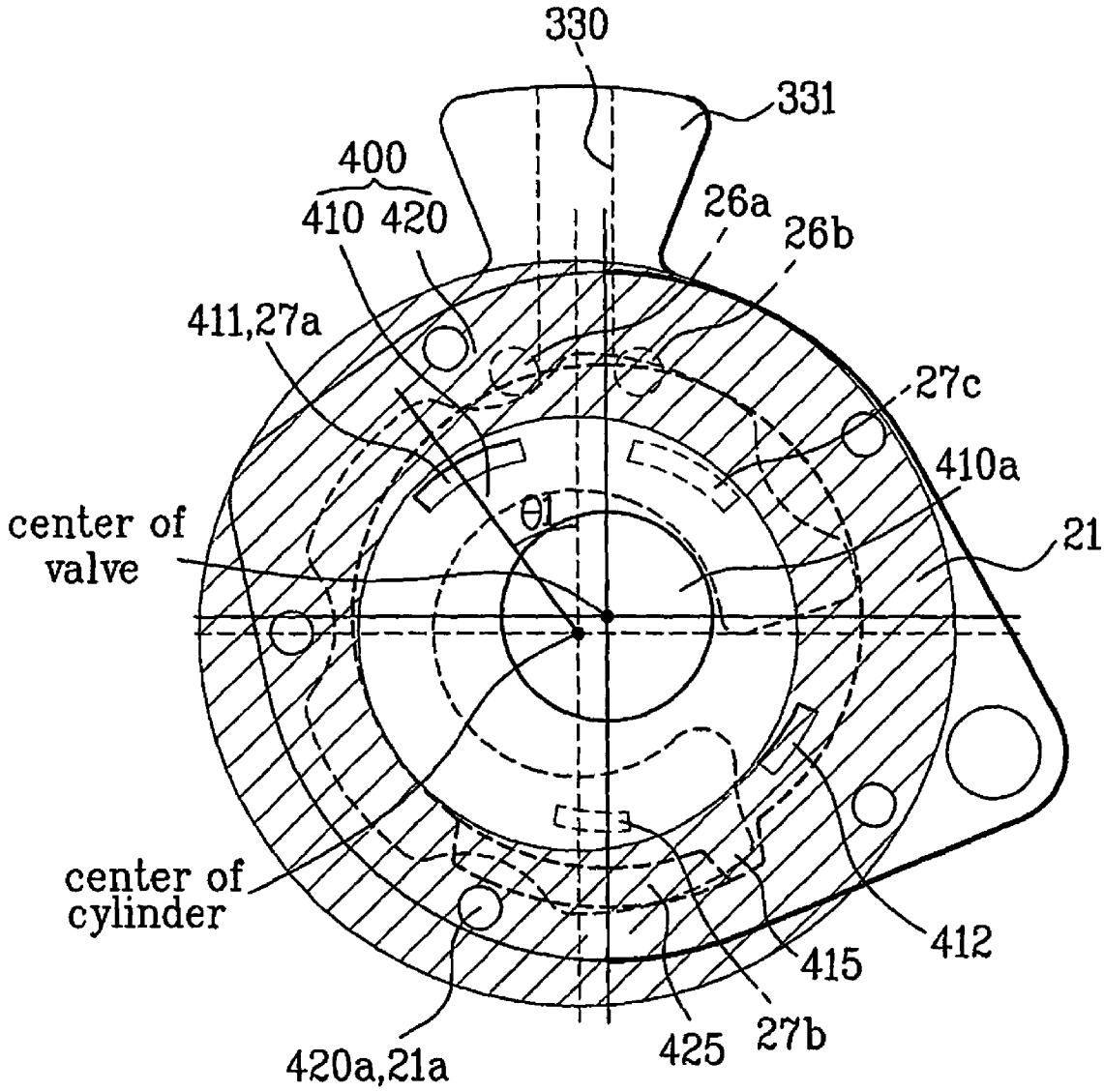
FIG. 20A is a cross-sectional view illustrating a structure when the roller rotates counterclockwise in the compressor of FIG. 18.
Figure 20B:
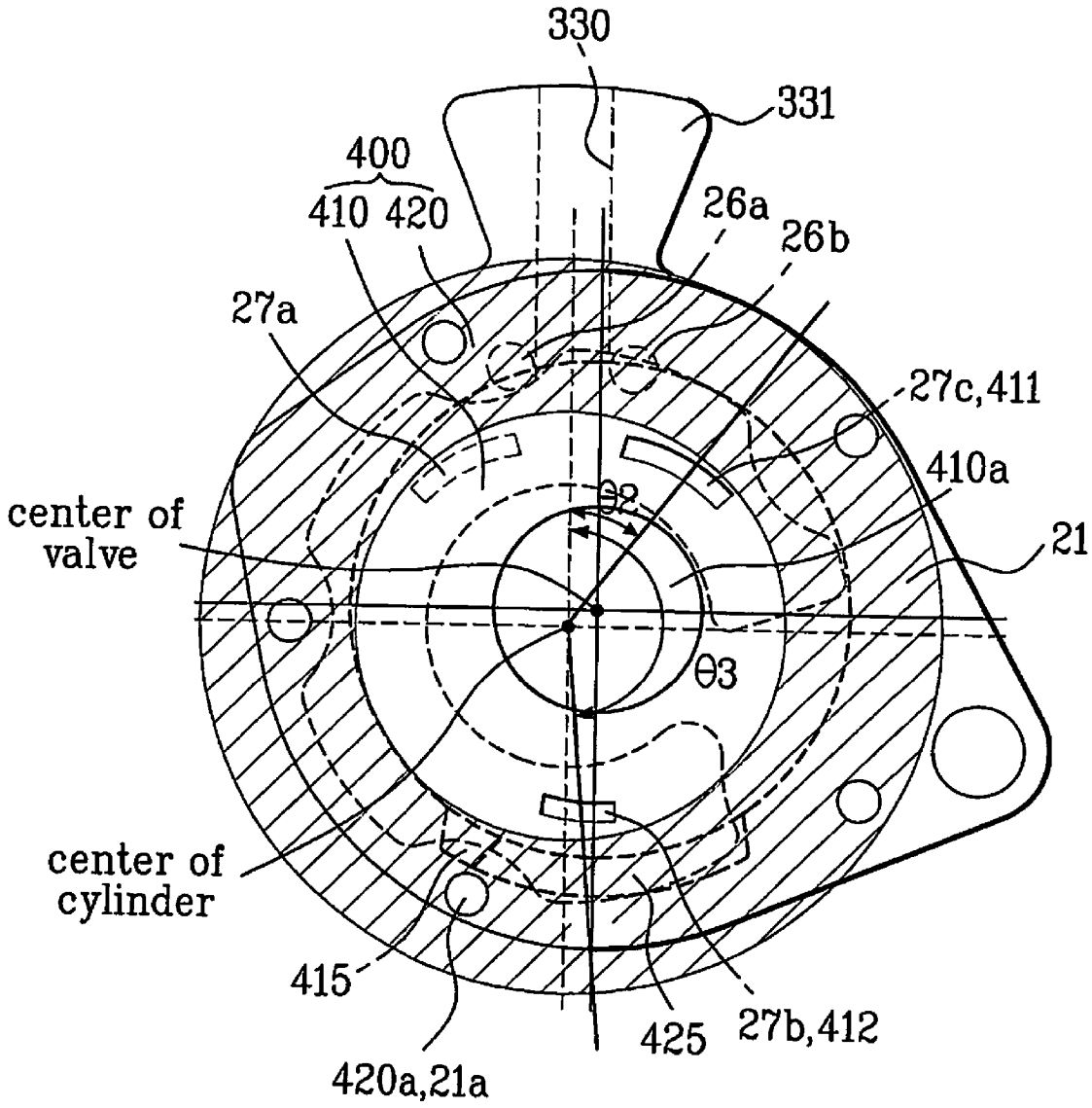
FIG. 20B is a cross-sectional view illustrating a structure when the roller rotates clockwise in the compressor of FIG. 18.

In the preceding embodiment, since the suction fluid passage is formed by the cylinder 21, the valve assembly 100 and the second bearing 25, it is longer substantially and the suction efficiency can be reduced. Instead of the suction fluid passage, the second bearing 300 can have a suction inlet 330 connected directly to the suction pipe 7. Accordingly, the suction fluid passage results in being simplified actually and shorter. Generally, the temperature of the inside of the compressor is high and the second bearing 300 is contacted with the hot lubricant stored on the bottom surface of the compressor. If the fluid stays in the second bearing long, it expands due to the hot environment. Accordingly, the fluid sucked into the cylinder 21 has less mass per a predetermined volume. In other words, the mass flowing amount of the fluid is reduced greatly and the compression efficiency is reduced. On this reason, the suction inlet 330 is preferably positioned in the vicinity of the vane 23 as shown in FIGS. 20A and 20B. In other words, the suction inlet 330 is positioned right under the vane 23. Accordingly, the fluid guided into the second bearing 330 through the suction inlet 330 is sucked into the cylinder 21 through the first opening 111 and the expansion of the fluid due to the hot environment is prevented. More preferably, the coupling 311 for fixing the suction pipe 7 is formed around the suction inlet 330. The coupling 311 extends surrounding the suction pipe 7 from the outer circumference of the second bearing 300 and accordingly the suction pipe 7 can be fixed on the second bearing 300 firmly.

By using the modified second bearing 300, the fluid chamber 29 communicates with the inner space of the second bearing 300 through the valve assembly 400 (that is, the first valve 410) without the first and second suction ports 27*a* and 27*b*. In the preceding embodiments, the suction ports 27*a* and 27*b* not only guides the fluid into the cylinder 21 (fluid chamber 29) but also determines a proper suction position for double compression capacity according to the rotation direction of the driving shaft 13. As described above, since the opening 300*a* of the second bearing 300 partly functions to guide the fluid, the valve assembly 100 should determine the suction position instead of the suction ports 27*a* and 27*b*. In more detail, the openings 411 and 412 of the first valve 410 should communicate with the second bearing 300 through the opening 300*a* of the second bearing 300 at the same position as the location of the suction ports 27*a* and 27*b* that are selectively opened according to rotation direction in the preceding embodiment. As a result, the openings 411 and 412 of the first valve 410 selectively communicate with the second bearing 300 at the same position as the location of the suction ports according to the rotation direction. Here, the position of the suction ports 27*a* and 27*b*, that is, the open location of the openings 111 and 112 is as the same as that described above referring to FIG. 4. The characteristics (the position and the number) of the discharge ports 26*a* and 26*b* are also the same as the preceding embodiments.

The valve assembly 400 has the same structure as those in the embodiments described with reference to FIGS. 14 to 17, but its function becomes different due to the existence of the second bearing 300. This valve assembly 400 will be described referring to FIGS. 20A and 20B. FIG. 20A illustrates the state that the first valve 410 rotates along with the driving shaft counterclockwise and FIG. 20B illustrates the state that the first valve 410 rotates along with the driving shaft clockwise.

As illustrated in FIGS. 20A and 20B, even when the second bearing 300 is used, the valve assembly 400 includes first valve 410 and second valve 420 installed between the cylinder 21 and the second bearing 300.

First, the first valve 410 is a disk member installed to contact the eccentric portion 13*a* and rotate in the rotation direction of the driving shaft 13. The first valve 410 includes first opening 411 and second opening 412 communicating with the fluid chamber 29 and the second bearing 300 only in a specific rotational direction of the driving shaft 13 as described above. The openings 411 and 412 should be arranged at proper positions such the fluid can be compressed between the discharge ports 26*a* and 26*b* and the roller 22. The fluid is substantially compressed from a single opening to a discharge port positioned in the revolution path of the roller 22. In other words, two compression capacities can be obtained using openings communicating with the fluid chamber 29 in different locations according to rotation direction. Accordingly, these openings 411 and 412 are spaced apart by a predetermined angle from each other to communicate with both of the fluid chamber 29 and the second bearing 300 at the different locations.

The valve assembly 400 is installed between the cylinder 21 and the second bearing 300 so as to have a center which is spaced apart by a predetermined distance from the center of the cylinder 21, i.e., the rotational center of the driving shaft 13. For this structure, the penetration hole 410*a* provided in the first valve 410 is formed larger than the driving shaft 13 by a distance which the center of the valve assembly 400 is axially biased from the center of the cylinder 21. This is because the valve assembly 400 needs an additional space corresponding to the axially biased distance so as not to restrain the driving shaft 13 during rotation of the driving shaft 13. Meanwhile, the size of the first valve 41 has to be smaller than the inner diameter of the cylinder 21, i.e., the diameter of the fluid chamber 29. When the first valve 410 rotates clockwise or counterclockwise, the outer circumference of the first valve 410, i.e., the site portion 421 of the second valve 420 is always positioned outside the fluid chamber 29. Only when the valve assembly is installed as aforementioned, the fluid is not leaked although the first valve 410 rotates in either clockwise direction or counterclockwise direction.

When the valve assembly 400 is installed as above, the first valve 410 rotates around a center spaced apart by a predetermined distance from the center of the cylinder 21. Accordingly, the second opening 412 formed in the first valve 410 is positioned inside the fluid chamber 29 to feed fluid into the fluid chamber 29 depending on the rotational direction of the roller 22, i.e., the rotational direction of the first valve 410 or is positioned outside the fluid chamber 29 to prevent the dead volume described as above. The first opening 411 is always positioned inside the cylinder 21 regardless of the rotational direction of the cylinder 21, and it communicates with the first suction port 27*a* or the third suction port 27*c* depending on the rotational direction to introduce the fluid into the fluid chamber 29. Hereinafter, the above operation will be described in more detail.

The first opening 411 communicates with the second bearing 300 due to the rotary motion of the first valve 410 when the driving shaft 13 rotates in one direction (counterclockwise as illustrated in FIG. 20A). The second opening 412 communicates with the second bearing 300 due to the rotary motion of the first valve 410 when the driving shaft 13 rotates in the other direction (clockwise as illustrated in FIG. 20A).

In more detail, the first opening 411 communicates with the second bearing 300 in the vicinity of the vane 23 when the driving shaft 13 rotates in one direction (counterclockwise as illustrated in FIG. 20A). Accordingly, the roller 22 compresses the fluid from the first opening 411 to the second discharge port 26*b* positioned across the vane 23 when rotating in one direction. At this time, the second opening 412, as shown in FIG. 20A, is positioned outside the fluid chamber 29, it is basically prevented that the pressure of the fluid chamber 29 is leaked to the inside of the second bearing 300 or that dead volume is generated. Thus, while the driving shaft 13 rotates counterclockwise, the roller 22 compresses the fluid due to the first suction port 27*a* by using all the chamber 29 and accordingly the compressor has the maximum compression capacity at a rotary motion in any one direction (counterclockwise). In other words, the fluid as much as the overall chamber volume is compressed. The communicating first opening 411 is spaced by an angle θ1 of 10° clockwise or counterclockwise from the vane 23 in one directional rotation of the driving shaft 13 like the first suction port 27*a* described in FIG. 4. In FIG. 20A, there is shown the first opening 411 spaced apart counterclockwise by the angle θ1 from the vane 23.

The second opening 412 is spaced by a predetermined angle from the vane 23 and communicates with the second bearing 300 when the driving shaft 13 rotates in the other direction (clockwise as illustrated in FIG. 20B). When the roller 22 rotates clockwise, the second opening 412 is positioned inside the fluid chamber 29. Hence, the fluid is sucked from the second bearing 30 through the second opening 412, and the roller 22 compresses the fluid from the second opening 412 to the first discharge port 26*a* when rotating clockwise. Since the second opening 412 is spaced by a considerable angle clockwise from the vane 23, the roller 22 compresses the fluid by using a portion of the chamber 29 and accordingly the compressor has a less compression capacity than that of counterclockwise rotary motion. In other words, the fluid as much as a portion volume of the chamber 29 is compressed. Preferably, the communicating second opening 412 is spaced apart by an angle θ2 in a range of 90-180° clockwise or counterclockwise from the vane 23 as the second suction port 27*b* illustrated in FIG. 4 when the driving shaft 13 rotates in the other direction. In FIG. 20B, there is shown the second opening 412 spaced apart by the angle θ2 clockwise. The second opening 412 preferably communicates with the second bearing 300 at the position facing the first opening 411 so that the difference between compression capacities can be made properly and the interference can be avoid for each rotation direction.

When the driving shaft 13 rotates clockwise, in other words, when the second opening 412 communicates with the second bearing 300, a vacuum region V is formed as illustrated in FIG. 4 while the roller revolves from the vane 23 to the communicating second opening 412. Accordingly, to remove the vacuum region, a third opening (not shown) communicating with the second bearing 300 is preferably formed at the same position of the third suction port 27*c* of FIG. 4. The third opening is the same as that illustrated in FIG. 6. The third opening communicates with the second bearing 300 between the second opening 412 and the vane 23. Accordingly, the third opening functions to supply the fluid to the space between the roller 22 and the vane 23 in order to prevent the vacuum state from being made before the roller passes the second opening 412. Since the third opening is operated with the second opening 412, these openings should be opened at the same time while the roller 22 revolves in one direction (clockwise in the drawing). The third opening may be formed independently as illustrated by the dotted line in FIG. 6. However, preferably, the first opening 411 substitutes for the third opening 113 by increasing the rotational angle of the first valve 410 when the driving shaft 13 rotates clockwise as illustrated FIG. 20B. The third opening preferably communicates with the second bearing 300 in the vicinity of the vane 23 so as to rapidly remove the vacuum when the driving shaft 13 rotates clockwise. More preferably, since the third opening should be operated with the second opening 412, the third opening is spaced apart by an angle θ3 of 10° clockwise or counterclockwise from the vane 23 to face the communicating position of the first opening 411. Since the first opening 411 communicates in the counterclockwise direction of the vane 23 in FIG. 20A, FIG. 20B illustrates the first opening 411 corresponding to the third opening spaced apart by the angle θ3 clockwise from the vane 23.

Meanwhile, to obtain a desired compression capacity from each rotation direction of the driving shaft, only one opened opening should exist for one rotation direction. If two openings are opened in the revolution path of the roller 22, the fluid is not compressed between these openings. In other words, if the driving shaft 13 rotates counterclockwise and the first opening 411 communicates with the second bearing 300, the second opening 412 should be closed. To achieve this, the second bearing 300 further includes a closing portion 340 configured to close the second opening 412 as illustrated in the drawings. The closing portion 340 is substantially a rib extending between the body 310 and the sleeve 320. The closing portion 340 contacts the lower surface of the first valve 410 around the second opening in order to prevent the fluid from being introduced into the second opening 412. Accordingly, the second opening 412 is closed by the closing portion 340 when the first opening 411 communicates due to the rotation of the first valve 110 as shown in FIG. 20A. Here, if the first valve 110 further includes the third opening, the third opening should be closed when the first opening 411 is opened in the counterclockwise rotation of the driving shaft 13. Accordingly, it is necessary to form an additional closing portion for the third opening on the second bearing 300. If the driving shaft 13 rotates clockwise, the second opening 412 and the third opening should communicate with the second bearing 300 due to the rotation of the first valve 110, but the first opening 411 should be closed. Accordingly, the second bearing 300 requires another closing portion for closing the first opening 411 when the driving shaft rotates clockwise. As a result, the second bearing 300 has a closing portion configured to selectively close the openings according to the rotation direction of the driving shaft 13. However, as described above, if the first opening 411 performs the role of the third opening instead of the third opening, an additional third opening is not formed. The first opening 411 communicates with the second bearing 300 simultaneously with the second opening 412 when the driving shaft rotates clockwise. In that case, openings for each of the first opening 411 and the third opening are not needed. Accordingly, as shown in FIGS. 20A and 20B, only one closing portion 340 for the second opening 412 is required, which is preferable to simplify the structure of the second bearing 300.

In the meanwhile, in a compressor with a structure that the second opening 412 is positioned outside the fluid chamber 29 when the valve assembly 400 is eccentrically installed and the roller 22 rotates counterclockwise like the present invention, the closing portion 340 may not be installed. Hence, the closing portion 340 is an element which is selectively applicable to the invention provided with the eccentrically installed valve assembly 400 according to the structure and location of the openings. Meanwhile, if the closing portion 340 is provided, the area to support the valve assembly 400 gets wider, pressure per unit area in the area supporting the valve assembly is decreased and thereby enhancement in the endurability can be anticipated.

In the first valve 410 described above, to obtain the desired compression capability, it is important that the corresponding openings 411 and 412 are positioned at predetermined locations precisely to communicate with the second bearing 300 for each rotation direction of the driving shaft 13. The precise communication of the openings 411 and 412 can be obtained by controlling the rotational angle of the first valve 410. Accordingly, the valve assembly 400 preferably further includes control means for controlling the rotational angle of the first valve 410. This means is substantially the same as the control means described illustrated in FIGS. 8 and 11. The control means will be described with reference to FIGS. 20A and 20B.

The control means shown in FIGS. 20A and 20B is the same as the control means shown in FIGS. 9A and 9B. In other words, the control means includes a projection 415 projecting from the first valve 400 in a radial direction of the first valve 400 and a groove 425 formed in the second valve 420, for movably accommodating the projection 415. When the control means is used and the driving shaft 13 rotates counterclockwise, the projection 415 is caught in an end of the groove 425 as shown in FIG. 20A. Accordingly, the first opening 411 communicates with the second bearing 300 such that the fluid is sucked into the cylinder 21 in the vicinity of the vane 23 as described above. The second opening 412 is closed since it is positioned outside the fluid chamber 29. In addition, if the driving shaft 13 rotates clockwise, as shown in FIG. 20B, the projection 415 is caught in the other end of the groove 425. At this point, the second opening 412 communicates with the second bearing 300 at a location spaced apart by a predetermined angle from the vane 23. At the same time, the first opening 411 communicates with the second bearing 300 between the vane 23 and the second opening 412. The fluid is sucked from the second bearing 300 into the cylinder 21 through both the communicating first and second openings 411 and 412. Besides, the control means shown in FIGS. 8A, 8B, 8C, 10A, 10B, 11A and 11B are applicable to the valve assembly 400 used together with the second bearing 300 without any change. However, in case of the control means shown in FIGS. 11A and 11B, the clearance between the projection 125 and the cut-away portion 117 communicates with the second bearing 300 instead of the first opening 411. In other words, the clearance communicates with the second bearing 300 in the vicinity of the vane 23 when the driving shaft 13 rotates counterclockwise. And also, the clearance communicates with the second bearing 300 along with the second opening 412 in the vicinity of the vane 23 when the driving shaft 13 rotates clockwise.

In the above, while only the inventive characteristics modified due to the second bearing 300 are described, other characteristics not mentioned are the same as those described previously.

The rotary compressor according to the invention can compress fluid regardless of the rotational direction of the driving shaft, and also has compression capacities varied with the rotational direction of the driving shaft. In particular, since the inventive rotary compressor has suction and discharge ports arranged at proper locations and a valve assembly for selectively opening the suction ports depending on the rotational direction of the driving shaft, it is possible to compress the entire portion of the predesigned fluid chamber. Also, since the inventive rotary compressor provides a structure in which the valve assembly is eccentrically installed, occurrence of dead volume can be basically prevented. Further, the inventive rotary compressor can preliminarily store fluid without an independent suction port such that the fluid is sucked into the cylinder, and employ a modified bearing for rotatably supporting the driving shaft.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

The rotary compressor constructed as above has following effects.

First, according to the related art, several devices are combined in order to achieve the dual-capacity compression. For example, an inverter and two compressors having different compression capacities are combined in order to obtain the dual compression capacities. In this case, the structure becomes complicated and the cost increases. However, according to the present invention, the dual-capacity compression can be achieved using only one compressor. Particularly, the present invention can achieve the dual-capacity compression by changing parts of the conventional rotary compressor to the minimum.

Second, the conventional compressor having a single compression capacity cannot provide the compression capacity that is adaptable for various operation conditions of air conditioner or refrigerator. In this case, power consumption may be wasted unnecessarily. However, the present invention can provide a compression capacity that is adaptable for the operation conditions of equipments.

Third, the rotary compressor of the present invention uses the entire portion of the predesigned fluid chamber in producing a dual-compression capacity. This means that the compressor of the present invention has at least the same compression capacity as the conventional rotary compressor having the same sized cylinder and fluid chamber. In other words, the inventive rotary compressor can substitute for the conventional rotary compressor without modifying designs of basic parts, such as cylinder size or the like. Accordingly, the inventive rotary compressor can be freely applied to required systems without any consideration of the compression capacity and any increase in unit cost of production.

Fourth, if the valve assembly is eccentrically installed about the center of the cylinder, occurrence of dead volume that may be caused in an output of a maximum compression capacity can be prevented in advance. If the occurrence of the dead volume is prevented in advance by the eccentric structure of the valve assembly, loss of compressible volume can be prevented, so that more enhanced output can be obtained in the same sized compressor. Also, increase in the load exerted by the driving shaft as rotated by the fluid accommodated in the dead volume is prevented, and vibration and noise are decreased.

Fifth, according to the present invention, in case of applying the modified bearing, the number of parts of the rotary compressor reduces and productivity increases. The modified bearing can support the valve assembly with the minimum contact area. Accordingly, a force of static friction between the valve assembly and the bearing is remarkably decreased, so that the valve assembly rotates easily along with the driving shaft. Further, the suction passage is substantially shorted since the modified bearing has a suction hole to which the suction pipe is directly connected. As a result, the pressure loss of fluid being sucked is reduced, thereby increasing the compression efficiency. Furthermore, the suction hole is positioned adjacent to the vane for the purpose of being close to the openings of the valve assembly, so that the fluid is promptly introduced into the cylinder through the openings. Accordingly, the compression efficiency is improved much more since the fluid is not expanded under a high temperature environment.

The invention claimed is:

1. A rotary compressor comprising:

a driving shaft being rotatable clockwise and counterclockwise, and having an eccentric portion of a predetermined size;

a cylinder forming a predetermined inner volume;

a roller installed rotatably on an outer circumference of the eccentric portion so as to contact an inner circumference of the cylinder, performing a rolling motion along the inner circumference and forming a fluid chamber to suck and compress fluid along with the inner circumference;

a vane installed elastically in the cylinder to contact the roller continuously;

a first bearing installed in the cylinder, for rotatably supporting the driving shaft;

a second bearing installed in the cylinder, for rotatably supporting the driving shaft and guiding the fluid into the fluid chamber;

discharge ports communicating with the fluid chamber; and a valve assembly having openings separated by a predetermined angle from each other, for allowing the openings to selectively introduce the fluid into the fluid chamber through the second bearing at a predetermined position of the fluid chamber according to rotation direction of the driving shaft, the valve assembly having a center which is eccentrically installed by a predetermined distance from a center of the cylinder.

2. The rotary compressor of claim 1, wherein the roller compresses the fluid using the overall fluid chamber only when the driving shaft rotates in any one of the clockwise direction and the counterclockwise direction.

3. The rotary compressor of claim 1, wherein the roller compresses the fluid using a portion of the fluid chamber when the driving shaft rotates in the other of the clockwise direction and the counterclockwise direction.

4. The rotary compressor of claim 1, wherein any one of the openings is positioned inside or outside the fluid chamber according to the rotation direction of the driving shaft.

5. The rotary compressor of claim 4, wherein when any one of the openings is opened according to the rotation direction of the driving shaft to introduce the fluid into the fluid chamber, the opened opening is positioned inside the fluid chamber, and when any one of the openings is closed, the closed opening is positioned outside the fluid chamber so as to prevent the fluid from being stored therein.

6. The rotary compressor of claim 1, wherein the discharge ports comprise a first discharge port and a second discharge port which are positioned facing each other with respect to the vane.

7. The rotary compressor of claim 1, wherein the valve assembly comprises:

a first valve installed rotatably between the cylinder and the bearing; and a second valve for guiding a rotary motion of the first valve.

8. The rotary compressor of claim 7, wherein the first valve comprises a disk member contacting the eccentric portion of the driving shaft and rotating in the rotation direction of the driving shaft.

9. The rotary compressor of claim 7, wherein the first valve has a diameter larger than an inner diameter of the cylinder.

10. The rotary compressor of claim 7, wherein the first valve rotates about a rotational center which is axially biased by a predetermined distance from a center of the driving shaft while the driving shaft rotates.

11. The rotary compressor of claim 7, wherein the second bearing comprises suction ports, which communicate with the fluid chamber and are spaced apart by a predetermined angle from each other.

12. The rotary compressor of claim 11, the suction ports comprise:

a first suction port located in the vicinity of the vane; and a second suction port spaced apart by a predetermined angle from the first suction port.

13. The rotary compressor of claim 12, wherein the first suction port is positioned spaced by approximately 10° from the vane clockwise or counterclockwise.

14. The rotary compressor of claim 12, wherein the second suction port is positioned in a range of 90-180° from the vane to face the first suction port.

15. The rotary compressor of claim 12, wherein the first valve comprises:

a first opening communicating with the first suction port when the driving shaft rotates in any one of the clockwise direction and the counterclockwise direction; and a second opening communicating with the second suction port when the driving shaft rotates in the other of the clockwise direction and the counterclockwise direction.

16. The rotary compressor of claim 15, wherein the second opening is positioned outside the fluid chamber when being positioned at a closed site by the rotation of the driving shaft.

17. The rotary compressor of claim 16, wherein the second opening is positioned outside the fluid chamber when the driving shaft rotates separated from the vane by a predetermined angle when the driving shaft rotates in any one of the clockwise direction and the counterclockwise direction and thereby the first suction port communicates with the first opening.

18. The rotary compressor of claim 15, wherein the first valve further comprises a third opening for opening the third suction port simultaneously when the second suction port is opened.

19. The rotary compressor of claim 15, wherein the first opening opens the third suction port as soon as the second suction port is opened.

20. The rotary compressor of claim 7, wherein the valve assembly further comprises control means for controlling a rotation angle of the first valve such that the corresponding suction ports are precisely opened according to the rotation directions.

21. The rotary compressor of claim 20, wherein the control means comprises:

a curved groove formed at the first valve and having a predetermined length; and a stopper formed on the bearing and inserted into the curved groove.

22. The rotary compressor of claim 21, wherein the control means comprises:

a projection formed on the first valve and projecting in a radial direction of the first valve; and a groove formed on the second valve, for receiving the projection movably.

23. The rotary compressor of claim 21, wherein the control means comprises:

a projection formed on the second valve and projecting in a radial direction of the second valve; and a groove formed on the first valve, for receiving the projection movably.

24. The rotary compressor of claim 21, wherein the control means comprises:

a projection formed on the second valve and projecting inwardly in a radial direction of the second valve; and a groove for movably receiving the projection formed in the first valve.

25. The rotary compressor of claim 24, wherein a clearance formed between the projection and the cut-away portion opens the first suction port or the third suction port according to the rotational direction of the driving shaft.

26. The rotary compressor of claim 1, wherein the second bearing comprises suction ports communicating with the fluid chamber and being spaced apart by a predetermined angle from each other.

27. The rotary compressor of claim 26, further comprising a plurality of suction pipes individually connected with the suction ports, for supplying the fluid to be compressed to the cylinder.

28. The rotary compressor of claim 26, further comprising a suction plenum connected with the suction ports, for preliminarily storing fluid to be compressed.

29. The rotary compressor of claim 28, wherein the suction plenum accommodates oil separated from the stored fluid.

30. The rotary compressor of claim 28, wherein the suction plenum is installed at a lower portion of the bearing in the vicinity of the suction port.

31. The rotary compressor of claim 28, wherein the suction plenum has 100-400% a volume as large as the fluid chamber.

32. The rotary compressor of claim 28, wherein the suction plenum is connected with a suction pipe through a predetermined fluid passage, the suction pipe supplying the fluid to be compressed.

33. The rotary compressor of claim 1, wherein the second bearing rotatably supports the driving shaft, and preliminarily stores the fluid to be sucked and then guides the fluid into the fluid chamber.

34. The rotary compressor of claim 33, the second bearing comprises:

a body defining a predetermined inner space; and a sleeve for receiving the driving shaft rotatably.

35. The rotary compressor of claim 34, wherein the valve assembly comprises:

a first valve installed rotatably between the cylinder and the bearing; and a second valve for guiding a rotary motion of the first valve.

36. The rotary compressor of claim 35, wherein the second bearing has a single opening that is formed on an upper portion of the body and communicates with the openings of the valve assembly.

37. The rotary compressor of claim 35, wherein the first valve comprises a disk member contacting the eccentric portion of the driving shaft and rotating in the rotation direction of the driving shaft.

38. The rotary compressor of claim 35, wherein the first valve has a diameter larger than an inner diameter of the cylinder.

39. The rotary compressor of claim 37, wherein the first valve rotates about a rotational center which is axially biased by a predetermined distance from a center of the driving shaft while the driving shaft rotates.

40. The rotary compressor of claim 35, wherein the first valve comprises:

a first opening communicating with the inner space when the driving shaft rotates in any one of the clockwise direction and the counterclockwise direction; and a second opening communicating with the inner space when the driving shaft rotates in the other of the clockwise direction and the counterclockwise direction.

41. The rotary compressor of claim 40, wherein the first opening is positioned in the vicinity of the vane when the driving shaft rotates in any one of the clockwise direction and the counterclockwise direction.

42. The rotary compressor of claim 40, wherein the second opening is positioned spaced apart by a predetermined angle from the vane when the driving shaft rotates in the other of the clockwise direction and the counterclockwise direction.

43. The rotary compressor of claim 40, wherein the second opening is positioned outside the fluid chamber when being positioned at a location closed by the rotation of the driving shaft.

44. The rotary compressor of claim 43, wherein the second opening is positioned outside the fluid chamber when the driving shaft rotates in any one of the clockwise direction and the counterclockwise direction and thereby the first opening is positioned in the vicinity of the vane.

45. The rotary compressor of claim 40, wherein the first and second openings are circular or polygonal.

46. The rotary compressor of claim 40, wherein the first and second openings are cut-away portions.

47. The rotary compressor of claim 40, wherein the first and second openings are rectangles each having a predetermined curvature.

48. The rotary compressor of claim 40, the first valve further comprises a third opening communicating with the second bearing simultaneously with the second opening when the driving shaft rotates in the other of the clockwise direction and the counterclockwise direction.

49. The rotary compressor of claim 48, wherein the third opening is positioned between the second opening and the vane.

50. The rotary compressor of claim 40, wherein the second bearing further comprises a closing portion configured to selectively close the openings according to the rotation direction of the driving shaft.

51. The rotary compressor of claim 50, wherein the closing portion selectively closes a second opening of a first valve of the valve assembly.

52. The rotary compressor of claim 51, wherein the second opening is positioned outside the fluid chamber when being positioned at a location closed by the rotation of the driving shaft.

53. The rotary compressor of claim 52, wherein the second opening is positioned outside the fluid chamber when the driving shaft rotates in any one of the clockwise direction and the counterclockwise direction and thereby the first opening is positioned in the vicinity of the vane.

54. The rotary compressor of claim 50, wherein the closing portion is a rib extending between the body and the sleeve.

55. The rotary compressor of claim 35, wherein the second bearing further comprises a supporting portion for supporting the valve assembly.

56. The rotary compressor of claim 55, wherein the supporting portion is comprised of one end of the sleeve configured to support the valve assembly.

57. The rotary compressor of claim 55, wherein the supporting portion is at least one boss including a coupling hole supporting the valve assembly and for coupling the second bearing to the cylinder.

58. The rotary compressor of claim 57, wherein the bosses are formed on a wall of the body.

59. The rotary compressor of claim 34, wherein the inner space has 100-400% a volume as large as the fluid chamber.

60. The rotary compressor of claim 34, wherein the second bearing accommodates oil separated from the stored fluid.

61. The rotary compressor of claim 34, wherein the second bearing further comprises a suction hole to which the suction pipe for supplying the fluid is connected.

62. The rotary compressor of claim 61, wherein the suction hole is positioned in the vicinity of the vane.

63. The rotary compressor of claim 61, wherein the suction pipe has a coupling (joint) configured to firmly fix the suction pipe to the suction hole around the suction pipe.

* * * * *